US005529116A

United States Patent [19]

Sasaki et al.

[11] Patent Number: 5,529,116

[45] Date of Patent: Jun. 25, 1996

[54] DUPLEX HEAT EXCHANGER

[75] Inventors: Hironaka Sasaki; Hirohiko Watanabe; Tetsuya Tategami; Nobuaki Goh, all of Oyamashi, Japan

[73] Assignee: Showa Aluminum Corporation, Osaka, Japan

[21] Appl. No.: 176,416

[22] Filed: Dec. 30, 1993

Related U.S. Application Data

[63] Continuation-in-part of Ser. No. 821,257, Jan. 10, 1992, abandoned, which is a continuation of Ser. No. 564,842, Aug. 9, 1990, abandoned.

[30] Foreign Application Priority Data

| | | | |
|---|---|---|---|
| Aug. 23, 1989 | [JP] | Japan | 1-217959 |
| Mar. 27, 1990 | [JP] | Japan | 2-80387 |
| Mar. 27, 1990 | [JP] | Japan | 2-80388 |

[51] Int. Cl.[6] ..... F28F 9/26

[52] U.S. Cl. ..... 165/144; 165/145; 123/41.51

[58] Field of Search ..... 165/144, 145, 165/150, 152; 123/41.51

[56] References Cited

U.S. PATENT DOCUMENTS

| | | | |
|---|---|---|---|
| 1,608,600 | 11/1926 | Howe | 123/41.51 X |
| 1,662,269 | 3/1928 | Howe | 123/41.51 X |
| 2,044,457 | 6/1936 | Young | 165/144 |
| 2,124,291 | 7/1938 | Fleisher | 165/145 |
| 2,184,657 | 12/1939 | Young | 165/145 |
| 3,112,793 | 12/1963 | Sass | 165/144 |
| 4,730,664 | 3/1988 | Forsthuber et al. | 123/41.51 X |
| 5,076,353 | 12/1991 | Haussmann | 165/144 X |
| 5,086,835 | 2/1992 | Shinmura | 165/144 |

FOREIGN PATENT DOCUMENTS

| | | | |
|---|---|---|---|
| 662841 | 8/1929 | France | 165/144 |
| 593691 | 1/1932 | Germany | 165/144 |
| 108956 | 8/1979 | Japan | 165/150 |
| 138986 | 8/1983 | Japan | 165/144 |
| 519752 | 4/1940 | United Kingdom | 123/41.51 |
| 707593 | 4/1954 | United Kingdom | 123/41.51 |

*Primary Examiner*—Leonard R. Leo

[57] ABSTRACT

A duplex heat exchanger comprises unit heat exchangers which have a plurality of tubes arranged parallel with each other and comprise fins each interposed between two adjacent ones of such tubes, opposite ends of each tube being connected to a pair of headers in fluid connection therewith. The unit heat exchangers are closely juxtaposed to each other fore and aft in a direction of air flow. Coolant circuits of said unit heat exchangers are connected either in series or in parallel with each other.

11 Claims, 30 Drawing Sheets

DUPLEX HEAT EXCHANGER

CROSS REFERENCE TO RELATED APPLICATIONS

The present application for patent is a continuation-in-part application of the patent application. No. 821,257, which was filed on Jan. 10, 1992, now abandoned a continuation application of the parent application No. 564,842 filed on Aug. 9, 1990 and now abandoned.

BACKGROUND OF THE INVENTION AND RELATED ART STATEMENT

The present invention relates to a heat exchanger, and more particularly to a duplex heat exchanger comprising a plurality of unit heat exchangers and adapted for use as the condensers or evaporators in car coolers or room coolers, or for use as the oil coolers for automobiles or the like.

The so-called multi-flow type heat exchanger has attracted public attention in the users mentioned above. This heat exchanger has a structure disclosed for example in the U.S. Pat. No. 4,825,941, such that a plurality of parallel flat tubes are connected to a pair of hollow headers at their opposite ends, respectively, with a corrugated fin interposed between one such flat tube and the next. In operation, heat exchange occurs between a coolant which flows through a coolant circuit composed of said flat tubes and air flows between the tubes. The known multi-flow type heat exchanger can be made thinner than the other known heat exchangers in its dimension in a direction of air flow, without affecting the efficiency of heat exchange. Therefore, said multi-flow type heat exchangers have proved better than the other known heat exchangers of some types such as the serpentine type.

In a case where a higher capacity of heat exchange is needed for the multi-flow type heat exchanger, vertical and/or horizontal dimensions thereof may be restricted by a given space for installation of said heat exchanger. In detail, length and the number of the tubes are generally delimited by the spatial condition. It may thus be regarded as feasible that the width of said tubes, i.e., the depth of said heat exchanger, be increased to meet the required greater capacity.

However, with a width of the heat exchanger as a whole being left unchanged, a larger width of the tubes will inevitably cause an outer diameter of the headers to be increased resulting in decrease of the tube's length effective to heat transfer. This problem has been a bottleneck in increasing the heat transfer capacity to a satisfactory degree.

Fleisher proposed in the U.S. Pat. No. 2,124,291 issued to him on Jul. 19, 1938 a duplex heat exchanger of the type comprising two unit heat exchangers, which were disposed in parallel with each other and fore and aft in the direction of air flow. It may be regarded as possible to simply arrange also fore and aft in the air flow direction the unit heat exchangers which are relatively thin and of the multi-flow type.

Since the headers in each unit heat exchanger constituting the duplex one is generally of a diameter larger than width of its tubes, the tubes in a front unit heat exchanger will be spaced a considerable distance from those in a rear one. Consequently, heat exchange capacity can not necessarily be raised in proportion to the increased depth of the duplex heat exchanger as a whole.

Further, a leeward unit heat exchanger is exposed to an air flow which has already passed through and heated by a windward one in the duplex heat exchanger. An efficient heat exchange cannot be expected between such a warm air and a coolant flowing through the leeward unit heat exchanger. It is also difficult from this point of view to raise heat exchange capacity in proportion to the increased depth of the duplex heat exchanger.

It will be another problem that in a case wherein the prior art duplex heat exchanger is used as an evaporator its leeward unit heat exchanger will scatter an amount of water condensed thereon.

OBJECTS AND SUMMARY OF THE INVENTION

An object of the present invention is therefore to raise heat transfer capacity of a duplex heat exchanger, without excessively increasing a space occupied thereby.

Another object is to provide a duplex heat exchanger which is improved in its overall efficiency of heat exchange.

Still another object of the invention is to provide a duplex heat exchanger which hardly scatters an amount of water condensed thereon.

The duplex heat exchanger proposed herein comprises in general: a plurality of unit heat exchangers arranged fore and aft in the direction of air flow; and a means for connecting a coolant circuit through one of the unit heat exchangers fluid-tightly to a further coolant circuit(s) through the other unit heat exchanger(s), wherein each of those unit heat exchangers comprises: a plurality of tubes disposed in parallel with each other; and a pair of hollow headers to which both ends of each tube are connected in fluid communication.

From a first aspect, the duplex heat exchanger provided herein is characterized in that the headers of a unit heat exchanger facing to windward are disposed, with regard to the air flow direction, offset relative to the headers of a unit heat exchanger(s) lying leeward.

Since the windward headers do not overlap with the leeward ones in such a duplex heat exchanger, its heat exchange capacity can be raised without excessively increasing its depth in the air flow direction.

From a second aspect, the duplex heat exchanger provided herein for use as a condenser is characterized in that circuits of a heat exchanging medium, which circuits are formed through the unit heat exchangers, are connected in series such that the medium flows through one of them and then the other(s), and in that an air side surface area for conducting heat exchange per unit area of the leeward unit heat exchanger ( hereinafter referred to as 'leeward U.H.E.') is larger than that of the windward unit heat exchanger (hereinafter referred to as 'windward U.H.E.').

From a third aspect, the duplex heat exchanger provided herein for use as a condenser is characterized in that circuits of a heat exchanging medium, which circuits are formed through the unit heat exchangers, are connected in parallel with each other such that the medium flows in harmony through all the circuits, and in that an air side surface heat exchange area per unit area of the leeward U.H.E. is larger than that of the windward U.H.E. This feature enables a tributary of the medium to have been sub-cooled well before leaving the leeward U.H.E., though heat exchange is conducted between an already warmed air stream and the tributary. Thus, another tributary which of course has been sub-cooled in the windward U.H.E. can join the first mentioned tributary of the heat exchanging medium.

From a fourth aspect, the duplex heat exchanger provided herein for use as a condenser is characterized in that circuits of a heat exchanging medium, which circuits are formed through the unit heat exchangers, are connected in parallel with each other such that the medium flows in harmony through all the circuits, and in that although the unit heat exchangers are substantially of the same size, at least one partition is secured in one or more headers so as to cause each circuit to meander making a U-turn(s). The leeward circuit makes a larger number of U-turns than the windward one, whereby the overall length of the former is greater than the latter to such an extent that both tributaries of the medium may have been sub-cooled in the respective unit heat exchangers before joining one another.

Although exposed to a preheated air stream from the windward U.H.E. in this type of duplex heat exchanger as a condenser, the leeward U.H.E. allows the medium flowing therethrough to perform well a heat exchange between it and such a warm air stream.

In the duplex heat exchanger of the structure just described above, all the tributaries respectively flowing through the parallel unit heat exchangers will be sub-cooled therein before they adjoin one another, to thereby improve an overall efficiency of heat exchange.

From a fifth aspect, the duplex heat exchanger provided herein for use as an evaporator is characterized in that circuits of a heat exchanging medium, which circuits are formed through the unit heat exchangers, are connected in series such that the medium flows through one of them and then the other, and in that dividual air flow paths are each defined between the adjacent tubes and separated by fins, in such a manner that cross-sectional area of each dividual air flow path in the leeward U.H.E. is larger than that in the windward U.H.E., whereby condensed water is prevented from flying off the leeward U.H.E.

From a sixth aspect, the duplex heat exchanger provided herein for use as an evaporator is characterized in that circuits of a heat exchanging medium, which circuits are formed through the unit heat exchangers, are connected in parallel with each other such that the medium flows in harmony through all of them, and in that dividual air flow paths are each defined between the adjacent tubes and separated by fins, such that cross-sectional area of each dividual path in the leeward U.H.E. is larger than that in the windward U.H.E., whereby condensed water is prevented from flying off the leeward U.H.E.

The duplex heat exchanger of any type outlined above for use as the evaporator is effective to avoid the problem of 'condensed-water flying' from the leeward U.H.E.

Other objects and additional advantages will become apparent from the embodiments setting forth the preferable modes of the present invention. However, the scope of invention is not delimited to those embodiments which can be modified without departing from the spirit of the present invention.

BRIEF DESCRIPTION OF THE DRAWINGS

FIGS. 1 to 9 show a duplex heat exchanger provided in a first embodiment, in which:

FIG. 1 is a perspective view of a windward unit heat exchanger and a leeward one separated therefrom but constituting the duplex heat exchanger;

FIG. 2 is a front elevation showing in entirety the duplex heat exchanger illustrated in FIG. 1;

FIG. 3 is a plan view of the duplex heat exchanger;

FIG. 4 is a left side elevation of the duplex heat exchanger;

FIG. 5 is a perspective view of headers, tubes and corrugated fins included in the windward or leeward unit heat exchanger, but separated one from another;

FIG. 6 is a cross section taken along the line 6—6 in FIG. 2;

FIG. 7 is an enlarged cross section of a portion of the windward or leeward unit heat exchanger, seen in the same direction as in FIG. 6;

FIG. 8 is an enlarged front elevation of the tubes and the corrugated fins; and FIG. 9 is a diagram showing a circuit which is formed for a heat exchanging medium through the duplex heat exchanger shown in FIG. 1;

FIGS. 13 to 21 show another duplex heat exchanger in a second embodiment, in which:

FIG. 13 is a perspective view corresponding to FIG. 1;

FIG. 14 is a front elevation corresponding to FIG. 2;

FIG. 15 is a plan view corresponding to FIG. 3;

FIG. 16 is a left side elevation corresponding to FIG. 4;

FIG. 17 is a perspective view corresponding to FIG. 5;

FIG. 18 is a perspective view showing partly in cross section tubes and corrugated fins in a windward unit heat exchanger and those in a leeward one;

FIG. 19 is an enlarged cross section corresponding to FIG. 7;

FIG. 20 is an enlarged front elevation corresponding FIG. 8;

FIG. 21 is a diagram corresponding to FIG. 9;

FIGS. 22 to 24 show still another duplex heat exchanger in a third embodiment, in which:

FIG. 22 is a perspective view showing in part and in separated state a windward and leeward unit heat exchangers in the duplex heat exchanger;

FIG. 23 is a left side elevation of the unit heat exchangers secured one to another; and FIG. 24 is a diagram of a circuit which is formed for a heat exchanging medium through the duplex heat exchanger shown in FIG. 22;

FIGS. 25 to 27 show a further duplex heat exchanger in a fourth embodiment, in which:

FIG. 25 is a perspective view showing in a separated state a windward and leeward unit heat exchangers in the further duplex heat exchanger;

FIG. 26 is a diagram of a circuit which is formed for a heat exchanging medium through the duplex heat exchanger shown in FIG. 25; and FIG. 27 is a perspective view showing partly in cross section tubes and corrugated fins in a windward unit heat exchanger and those in a leeward one;

FIGS. 28 to 30 show a still further duplex heat exchanger in a fifth embodiment, in which:

FIG. 28 is a perspective view of the heat exchanger in its entirety;

FIG. 29 is a diagram of a circuit which is formed for a heat exchanging medium through the duplex heat exchanger shown in FIG. 28; and FIG. 30 is a perspective view showing partly in cross section tubes and corrugated fins in a windward unit heat exchanger and those in a leeward one;

FIGS. 31 to 33 show a yet still further duplex heat exchanger in a sixth embodiment, in which:

FIG. 31 is a perspective view of the heat exchanger in its entirety;

FIG. 32 is a diagram of a circuit which is formed for a heat exchanging medium through the duplex heat exchanger shown in FIG. 31; and FIG. 33 is a perspective view showing partly in cross section tubes and corrugated fins in a windward unit heat exchanger and those in a leeward one;

FIGS. 34 to 35 show yet another duplex heat exchanger in a seventh embodiment, in which:

FIG. 34 is a perspective view of the heat exchanger in its entirety; and

FIG. 35 is a flow diagram of a heat exchanging medium in the heat exchanger shown in FIG. 34;

FIGS. 36 and 37 show a still further duplex heat exchanger in an eighth embodiment, in which:

FIG. 36 is a horizontal cross section of the heat exchanger; and

FIG. 37 is a cross section taken along the line 37—37 in FIG. 36;

FIGS. 38 to 40 show a still further duplex heat exchanger in a ninth embodiment, in which:

FIG. 38 is a perspective view of the heat exchanger in its entirety;

FIG. 39 is a flow diagram of a heat exchanging medium in the heat exchanger shown in FIG. 38; and FIG. 40 is a perspective view showing partly in cross section tubes and corrugated fins in a windward unit heat exchanger and those in a leeward one;

FIGS. 41 to 43 show a yet still further duplex heat exchanger in a tenth embodiment, in which:

FIG. 41 is a perspective view of the heat exchanger in its entirety;

FIG. 42 is a flow diagram of a heat exchanging medium in the heat exchanger shown in FIG. 41; and FIG. 43 is a perspective view showing partly in cross section tubes and corrugated fins in a windward unit heat exchanger and those in a leeward one;

FIGS. 44 to 46 show still another duplex heat exchanger in an eleventh embodiment, in which:

FIG. 44 is a perspective view of the heat exchanger in its entirety;

FIG. 45 is a flow diagram of a heat exchanging medium in the heat exchanger shown in FIG. 44; and FIG. 46 is a perspective view showing partly in cross section tubes and corrugated fins in a windward unit heat exchanger and those in a leeward one;

FIGS. 47 to 49 show yet still another duplex heat exchanger in a twelfth embodiment, in which:

FIG. 47 is a perspective view of the heat exchanger in its entirety;

FIG. 48 is a flow diagram of a heat exchanging medium in the heat exchanger shown in FIG. 47; and FIG. 49 is a perspective view showing partly in cross section tubes and corrugated fins in a windward unit heat exchanger and those in a leeward one;

FIGS. 50 to 52 show a duplex heat exchanger in a thirteenth embodiment, in which:

FIG. 50 is a perspective view of the heat exchanger in its entirety;

FIG. 51 is a flow diagram of a heat exchanging medium in the heat exchanger shown in FIG. 50; and FIG. 52 is a perspective view showing partly in cross section tubes and corrugated fins in a windward unit heat exchanger and those in a leeward one;

FIGS. 53 to 55 show a further duplex heat exchanger in a fourteenth embodiment, in which:

FIG. 53 is a perspective view of the heat exchanger in its entirety;

FIG. 54 is a flow diagram of a heat exchanging medium in the heat exchanger shown in FIG. 53; and FIG. 55 is a perspective view showing partly in cross section tubes and corrugated fins in a windward unit heat exchanger and those in a leeward one;

FIGS. 56 to 58 show a still further duplex heat exchanger in a fifteenth embodiment, in which:

FIG. 56 is a perspective view of the heat exchanger in its entirety;

FIG. 57 is a flow diagram of a heat exchanging medium in the heat exchanger shown in FIG. 56; and FIG. 58 is a perspective view showing partly in cross section tubes and corrugated fins in a windward unit heat exchanger and those in a leeward one;

FIGS. 59 to 61 show a yet still further duplex heat exchanger in a sixteenth embodiment, in which:

FIG. 59 is a perspective view of the heat exchanger in its entirety;

FIG. 60 is a flow diagram of a heat exchanging medium in the heat exchanger shown in FIG. 59; and FIG. 61 is a perspective view showing partly in cross section tubes and corrugated fins in a windward unit heat exchanger and those in a leeward one.

DETAILED DESCRIPTION OF THE PREFERRED EMBODIMENTS

First Embodiment

Figure 1:
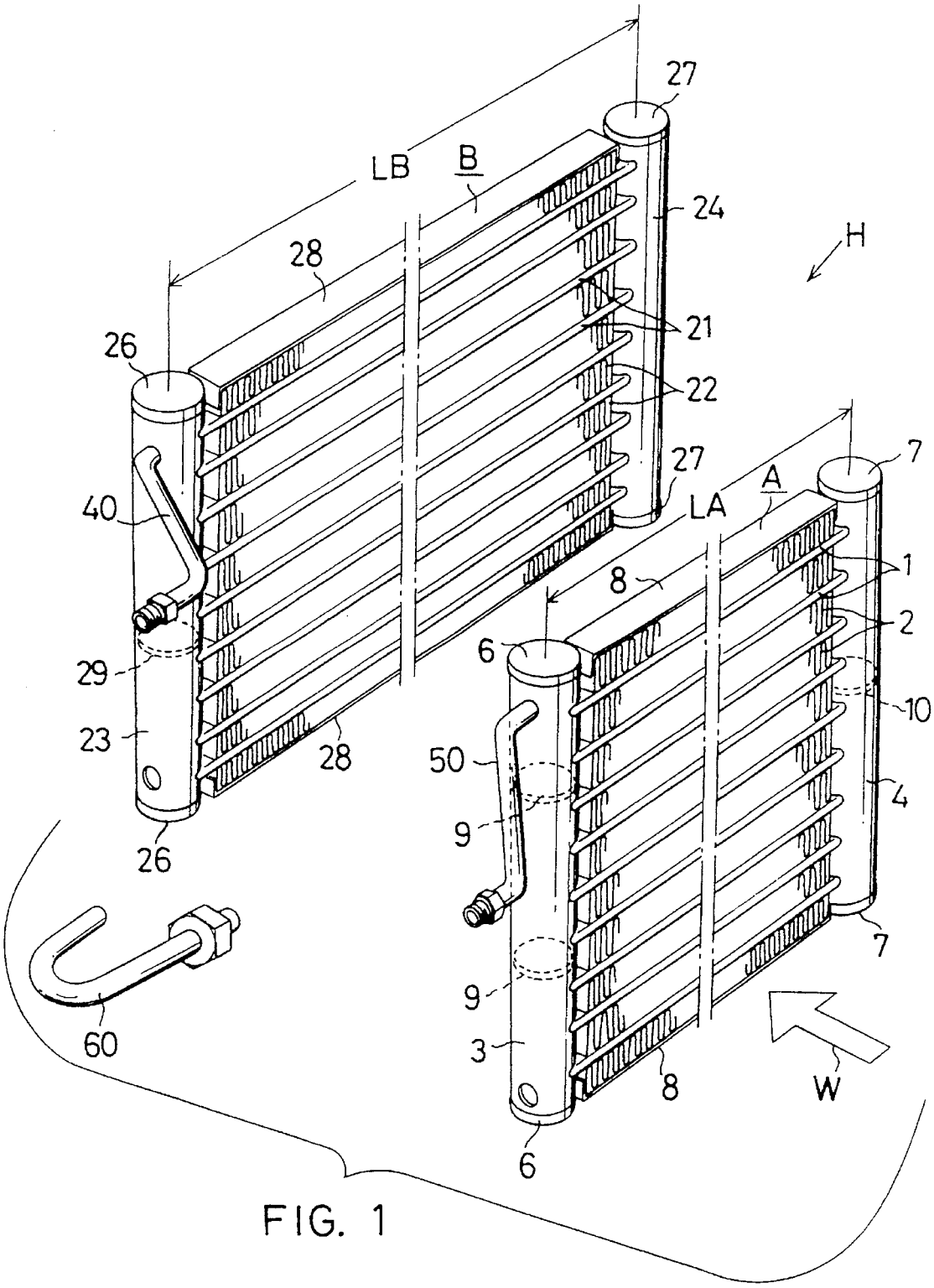

FIGS. 1 to 9 shows an embodiment in which the present invention is applied to a condenser made of aluminum and for use in a car cooler.

The reference symbol 'H' in these figures generally denotes a duplex heat exchanger.

The duplex heat exchanger 'H' comprises a windward unit heat exchanger 'A' and a leeward one 'B' which are arranged fore and aft in the direction 'W' of a heat exchanging air flow, with the unit heat exchangers closely juxtaposed to face one another.

The windward unit heat exchanger 'A' is composed of a plurality of horizontally disposed tubes 1 stacked one above another, corrugated fins 2 each interposed between the two adjacent tubes, and a left-hand and right-hand headers 3 and 4.

The tubes 1 are made of an extruded flat aluminum profile pipe. A partitioning wall la extends longitudinally of each tube 1 so as to make it perforated of the so-called 'harmonica' shape. Alternatively, each tube may be a length of seam-welded pipe.

The corrugated fins 2 are substantially of the same width and brazed to the adjacent tubes. The fins 2 also are made of aluminum, and preferably, louvers are opened up from each fin.

The headers 3 and 4 are lengths of an aluminum pipe round in cross section and having an outer and/or inner peripheral surfaces coated with a brazing agent layer. Tube receiving apertures 5 are formed at regular intervals along each header so that both ends of each tube 1 are inserted in and securely brazed to the apertures 5. Cover plates 6 are fixed on an upper and lower ends of the left-hand header 3, with further cover plates 7 also being fixed on such ends of the right-hand header 4. Side plates 8 are disposed outside the outermost corrugated fins 2.

Similarly to the windward unit heat exchanger 'A', the leeward one is also composed of tubes 21, corrugated fins 22, a left-hand and right-hand headers 23 and 24, tube receiving apertures 25, cover plates 26 and 27, and side plates 28 and 28. However, a distance 'LB' between the left-hand and right-hand headers 26 and 27 is greater than that 'LA' between the headers in the windward unit heat exchanger 'A'.

Figure 3:
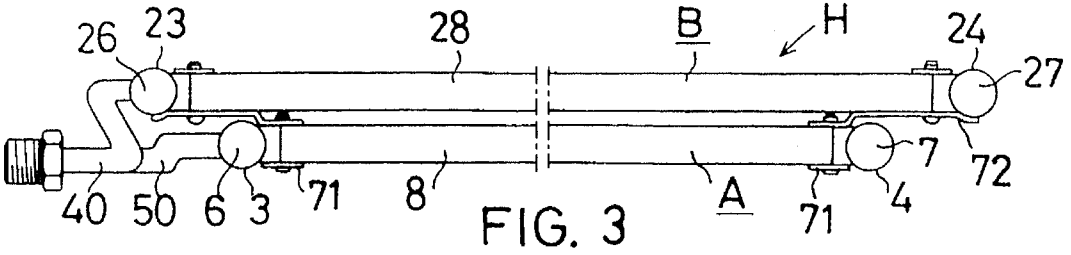
Figure 2:
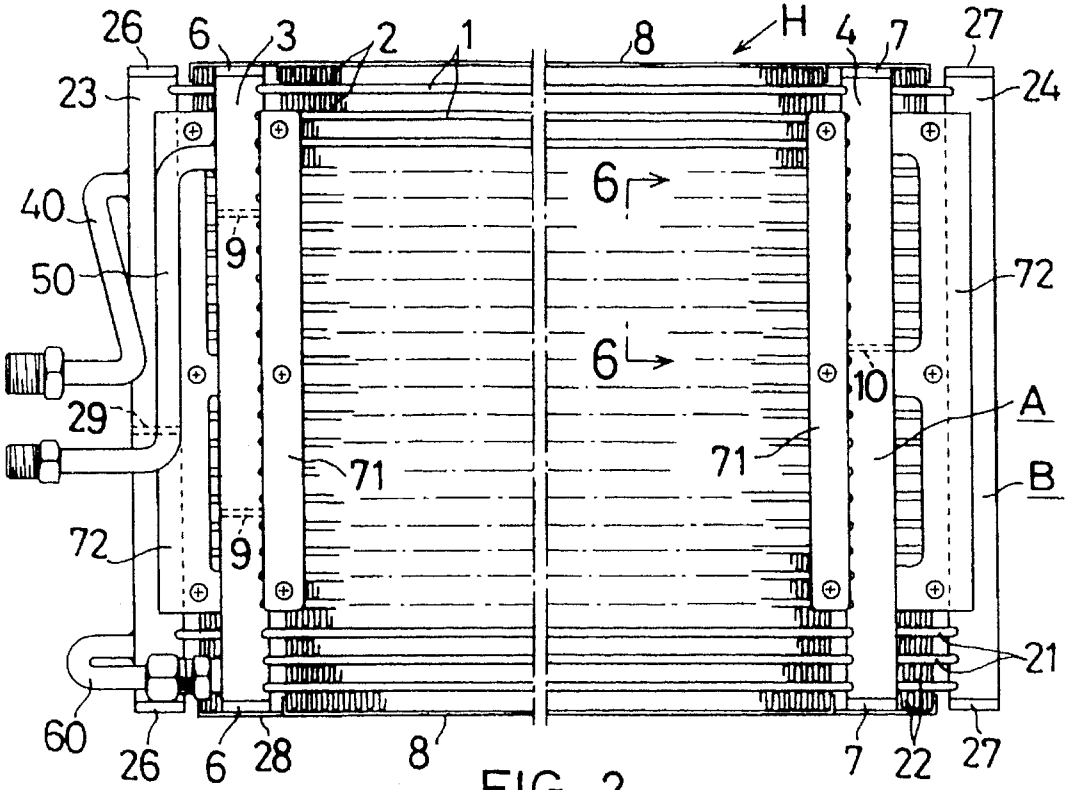
Figure 4:
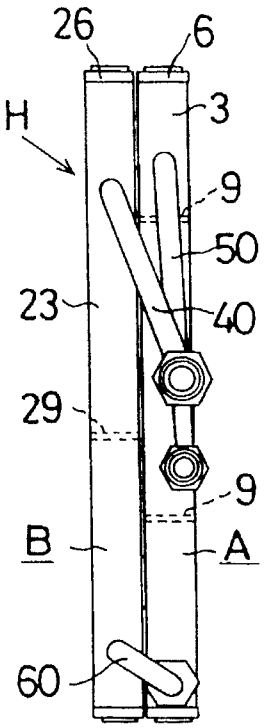
Figure 5:
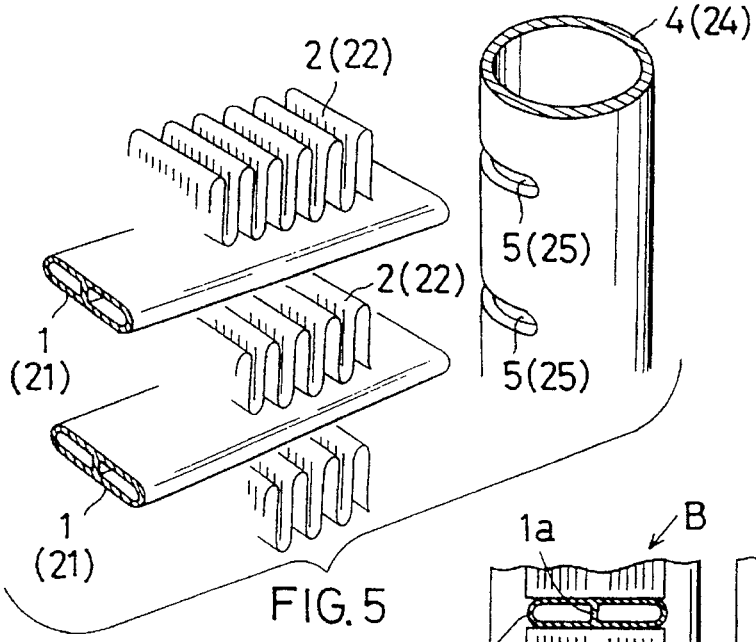
Figure 6:
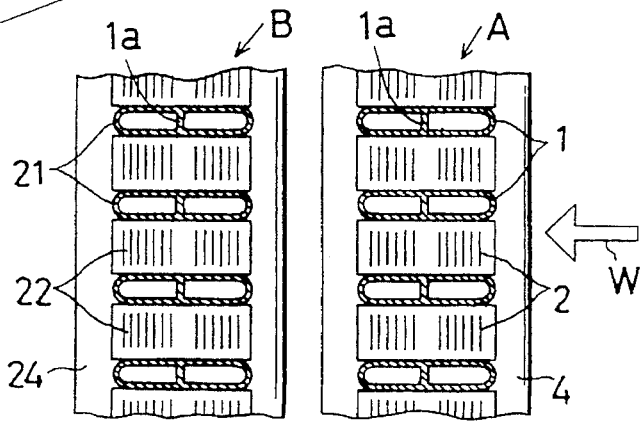
Figure 7:
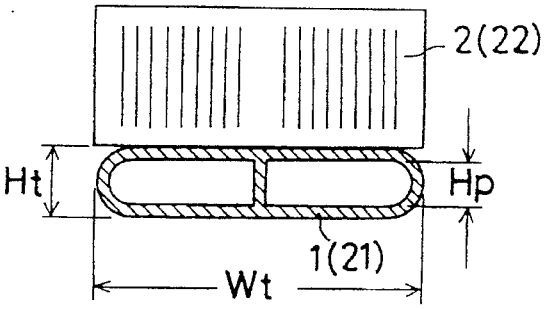
Figure 8:
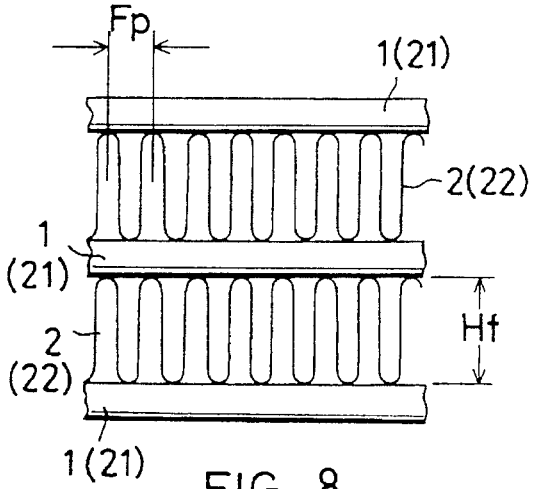
Figure 9:
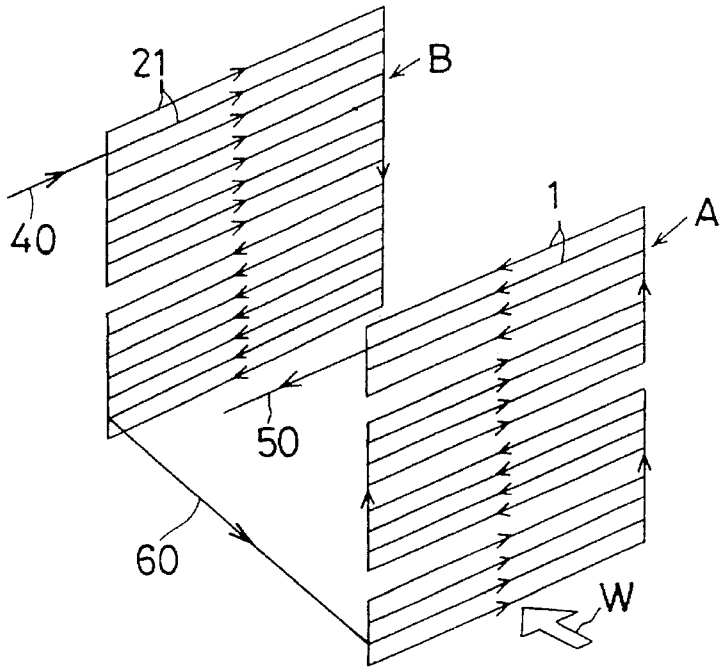

The windward and leeward unit heat exchangers 'A' and 'B' are arranged fore and aft to face one another in a positional relationship shown in FIGS. 2 and 3. In detail, the left- and right-hand headers 3 and 4 of the windward heat exchanger 'A' are disposed inside those headers 23 and 24 of the leeward one 'B'. Due to such a location of the unit heat exchangers 'A' and 'B' having different distances 'LA' and 'LB' between their headers, the forehand headers do not overlap with the rearward ones, thus reducing the fore-and-aft thickness of the heat exchanger as a whole. By virtue of such a compactness, space occupied by it in an automobile body or the like can be made smaller to eliminate any dead space.

A coolant circuit consisting of coolant paths in the windward unit heat exchanger 'A' is connected in series to that in the leeward one 'B'. In detail, a coolant inlet pipe 40 is attached to an upper portion of the left-hand header 23 in the leeward unit heat exchanger 'B'. A coolant outlet pipe 50 is attached to an upper portion of the left-hand header 3 in the windward one 'A', with lower portions of the left-hand headers 3 and 23 communicating with each other through a joint pipe 60. The reference numerals 71 and 72 in FIGS. 2 and 3 denote brackets for fixing the unit heat exchangers one to another.

A partition plate 29 which is secured in and at a middle height of the left-hand header 23 of the leeward unit heat exchanger 'B' divides the interior of the header into an upper and lower chambers. As for the windward heat exchanger, one of two partition plates 9 in its left-hand header 3 is positioned above its middle height, and the other 9 being below it so that the interior of this header 3 is divided into three, i.e., a top, a middle and a bottom chambers. A further partition plate 10 secured in and at a middle height of the right-hand header 4 of the windward heat exchanger 'A' likewise divides its interior into two chambers. Due to the partition plates 29, 9 and 10, a coolant fed through the inlet pipe 40 and entering the left-hand header 23 of the leeward unit heat exchanger 'B' will flow in a manner shown in FIG. 9. In detail, the coolant will make one U-turn so as to flow through one group of tubes and then through the other, before advancing into the lower chamber of the header 23 and moving through the joint pipe 60 into the bottom chamber of the left-hand header 3 of windward heat exchanger 'A'. The coolant makes three U-turns while ascending within this heat exchanger 'A' and before flowing into, and subsequently out of, the top chamber in the left-hand header 3. Heat exchange will be conducted between an air flow indicated at 'W' and the coolant flowing through the tubes included in the unit heat exchangers.

Since the coolant is caused to flow from the leeward unit heat changer 'B' to the windward one 'A', a temperature difference between the coolant and the air flow is kept great enough to ensure an efficient heat exchange.

The coolant makes more U-turns within the windward unit heat exchanger 'A' than within the leeward one 'B', so that overall cross-sectional area of unit flow paths per one pass of the coolant within the former 'A' is less than that within the latter 'B'. Such a condenser is advantageous in that its coolant passageway gradually decreases in cross section in unison with the change in coolant volume. In detail, although the coolant flowing into or having just entered the leeward heat exchanger 'B' is still in its voluminous gaseous state, it will subsequently be cooled through heat exchange and liquefied to gradually decrease its volume. A larger cross-sectional area allotted to the coolant gas within the leeward heat exchanger 'B' efficiently cools the gas, while a smaller cross-sectional area is enough for the coolant liquid within the windward one 'A' to undergo a sufficient heat exchange. An overall heat exchange efficiency is improved in this manner, and a pressure loss of the coolant is diminished at the same time in this duplex heat exchanger.

The total cross-sectional area of tubes constituting the final coolant pass in the windward heat exchanger 'A' is desirably to be 30%–60% of that for the first pass in the leeward one 'B'. The former area less than 30% of the latter area is too narrow to diminish the coolant pressure loss in the windward coolant paths as a 'sub-cooling zone'. At the same time, a flow speed of the coolant through the leeward paths as a 'condensing zone' will be made undesirably slow due to an excessively large cross sectional area, thereby failing to ensure an efficient heat exchange. If contrarily the cross-sectional area for the final pass is greater than 60% of that for the first pass, then each 'condensing' pass in the leeward heat exchanger 'B' will be too narrow to diminish the coolant pressure loss therein, also impairing the heat exchange efficiency due to the insufficient heat conducting area. For the reasons set forth above, the total cross-sectional area of tubes constituting the final pass in windward heat exchanger 'A' has to be 30%–60% of that for the first pass in the leeward one 'B', and more preferably 35%–50%.

Other parameters, which are selected for better performance of the unit heat exchangers 'A' and 'B' arranged fore and aft, are as follows.

Regarding the tubes 1 and 21, their width 'Wt', outer height 'Ht' and inner height 'Hp' defining a coolant path are desirably 6–20 mm, 1.5–7 mm and 1.0 mm or more, respectively. The height 'Hf' of the corrugated fins 2 and 22, that is a distance between the adjacent tubes 1 and 1 or 21 and 21, is desirably 6–16 mm, and their fin pitch 'Fp' is desirably 1.6–4.0 mm. Reasons for such dimensions will be given below.

Tube width 'Wt' smaller than 6 mm will render excessively narrow the fins 2 or 22 interposed between the tubes so that heat exchange capacity is impaired. However, a tube width greater than 20 mm will render the fins too broad to suppress the flow resistance of air stream penetrating them, and also render the condenser undesirably heavy. Therefore, the tube width is to be 6–20 mm, more preferably 6–16 mm, and most preferably 10–14 mm. The height 'Ht' of tubes taller than 7 mm will cause an undesirably high pressure loss of air streams flowing between them. However, if the tube height 'Ht' is less than 1.5 mm, then a necessary wall thickness of each tube will make it difficult to assure the coolant path height 'Hp' of 1.0 mm or more. Therefore, the tube height is to be 1.5–7 mm, more preferably 1.5–5 mm, and most preferably 2–4 mm.

The coolant path height 'Hp' lower than 1.0 mm will cause an undesirably high pressure loss of coolant, thereby lowering the heat exchange efficiency. Therefore, the height 'Hp' is to be 1.0 mm or greater, more preferably 1.0–3.0 mm, and most preferably 1.5–2.0 mm.

The fin height 'Hf' lower than 6 mm will cause an undesirably increased pressure loss of air flow, but the height 'Hf' taller than 16 mm will reduce the number of fins per unit heat exchanger thereby impairing the heat exchange efficiency. Therefore, the fin height is to be 6–16 mm, more preferably 8–16 mm, and most preferably 8–12 mm.

The fin pitch 'Fp' less than 1.6 mm will cause an undesirably increased pressure loss of air flow, but the pitch 'Hf' greater than 4.0 mm will impair the heat exchange efficiency. Therefore, fin pitch is to be 1.6–4.0 mm, more preferably 2–3.6 mm, and most preferably 2–3.2 mm.

As described above, the most adequate dimensions are selected as to the shapes of tubes 1 and 21 and the corrugated fins 2 and 22 which give important influences on the performance of condenser. Selection of the dimensions of tube width, tube height, inner height of coolant path, fin height and fin pitch respectively from the ranges referred to above will provide the condenser operable efficiently in an optimal manner, wherein a good balance is realized between the pressure loss of coolant or air flow and the heat transfer characteristics, without causing any significant increase in the weight of condenser.

The present invention can be embodied in any manner other than that exemplified above, without departing from the spirit of invention and insofar as the requirements included therein are met. For example, the present invention is not restricted to the condenser, but applicable to an evaporator, an oil cooler, a radiator or any other multi-flow duplex heat exchanger of a header type.

It is the most fundamental feature of the present invention that a plurality of unit heat exchangers facing one another are arranged fore and aft in the direction of air flow, and the windward unit heat exchanger has headers disposed offset from those in the leeward one(s) with respect to the air flow direction.

Figure 10:
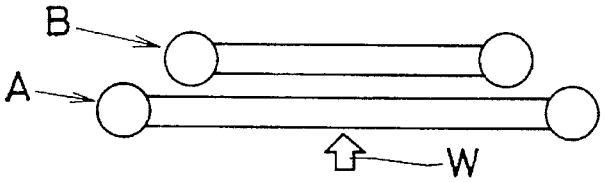
FIGS. 10 to 12 are schematic plan views showing modifications of the first embodiment.

Thus, a distance between the headers of the windward heat exchanger 'A' may be greater than that of the leeward one, as shown in FIG. 10.

Figure 11:
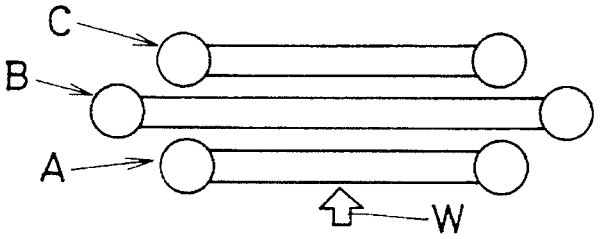

Further, three or more unit heat exchangers 'A', 'B', 'C', etc. may constitute one duplex heat exchanger, as shown in FIG. 11.

Figure 12:
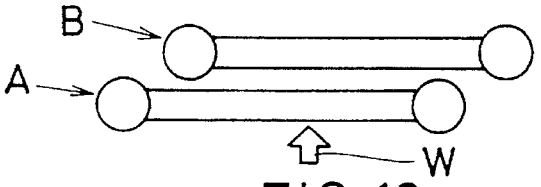
Figure 13:
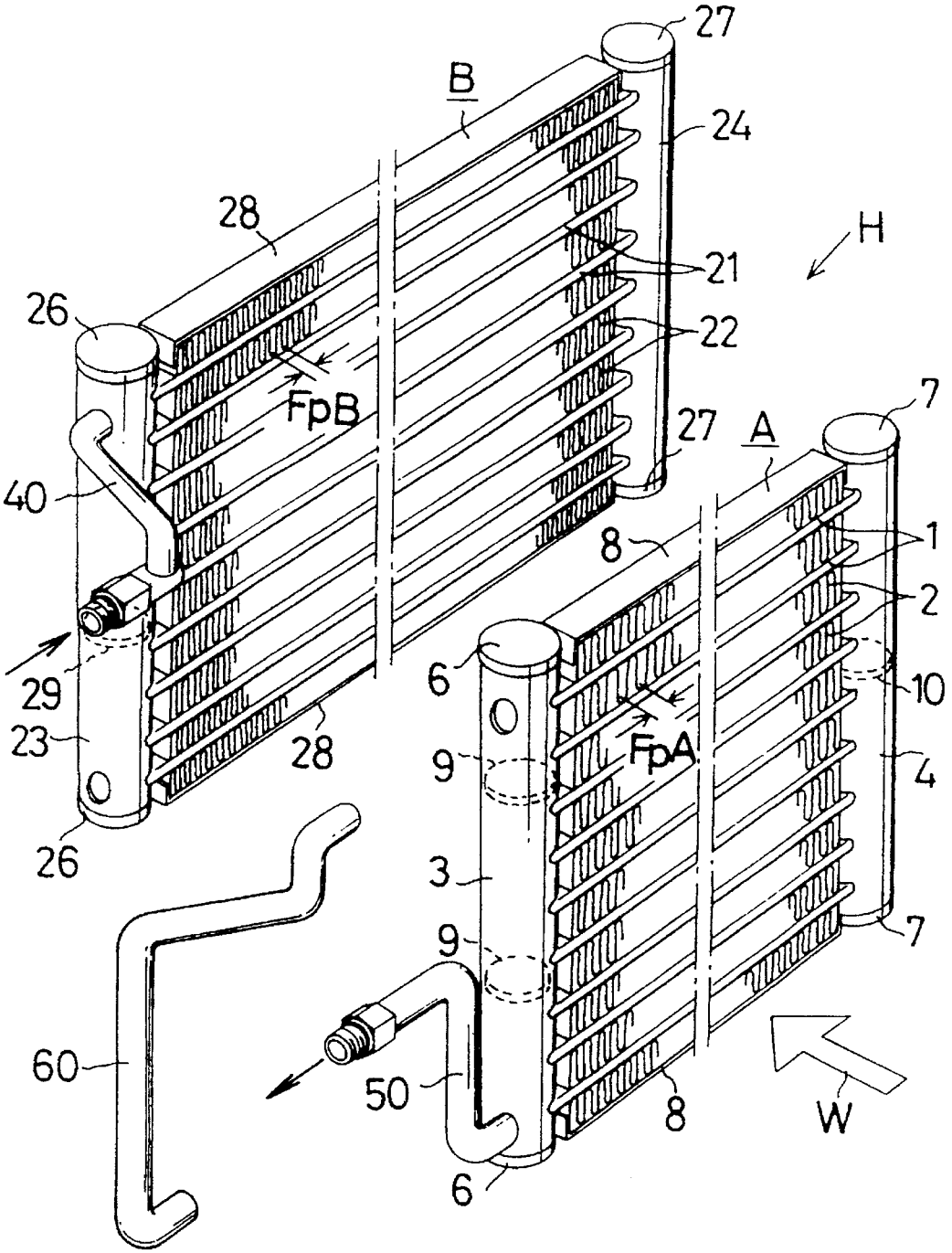
Figure 15:
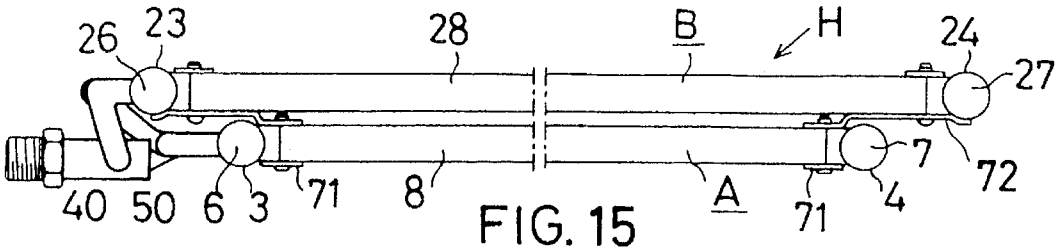
Figure 14:
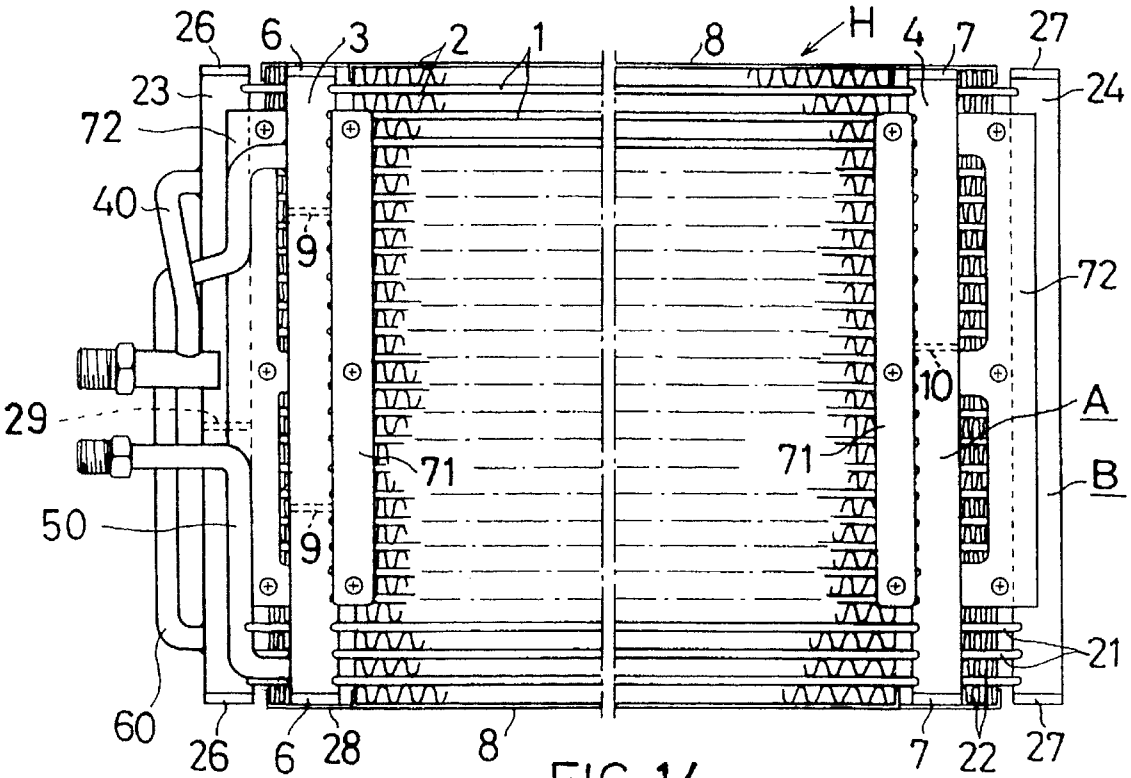
Figure 16:
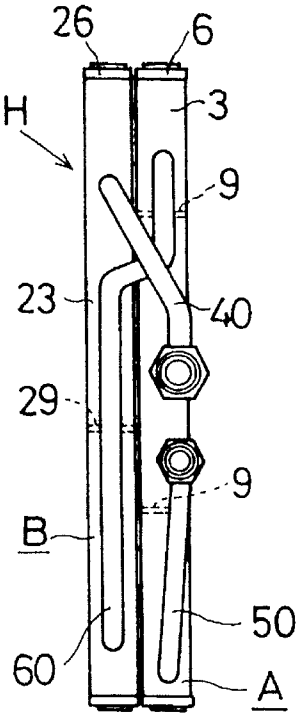
Figure 17:
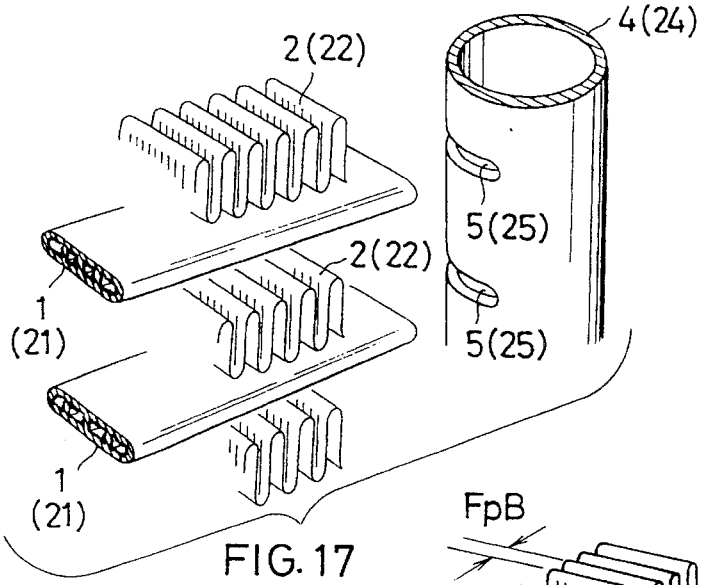
Figure 18:
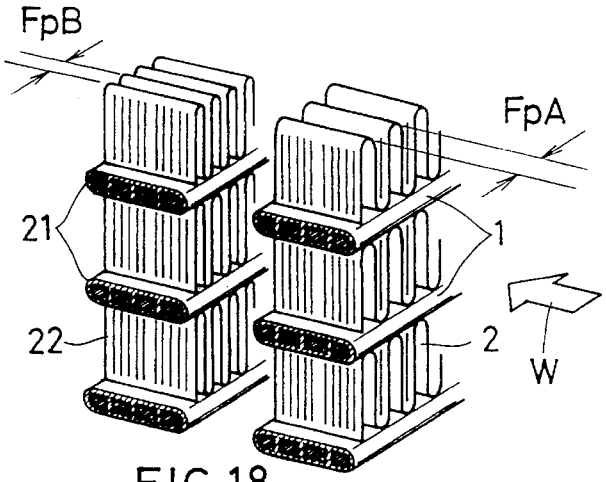
Figure 19:
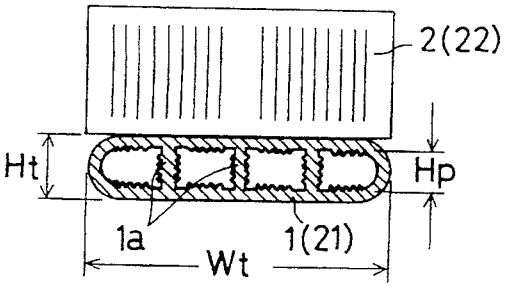
Figure 20:
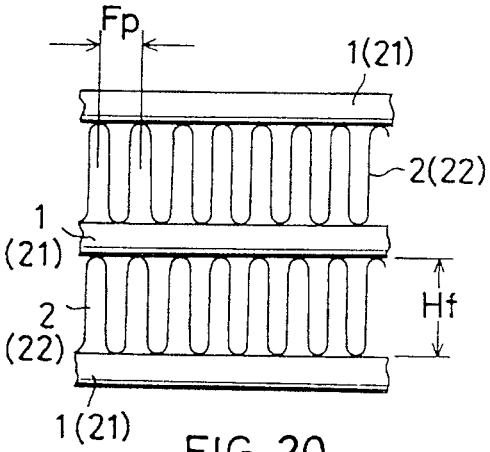

All the unit heat exchangers may not necessarily have different distances between their headers, but they 'A' and 'B' may have the same distance between their headers in a manner shown in FIG. 12, or alternatively two or more of the unit heat exchangers are the same in respect of said distance.

In addition, the unit heat exchangers need not be connected in series as shown in the described embodiment, but may be connected in parallel one with another.

The preferred embodiments described above and added below are therefore merely illustrative and not restrictive, with the scope of the invention being indicated by the appended claims and all variations or modifications which fall within the meaning and scope of the claims are embraced herein.

Second Embodiment

FIGS. 13 to 21 show a second embodiment of the present invention.

Description of the parts to which the same reference numerals as those in the first embodiment are allotted will not be repeated here.

The invention is also applied to a condenser, and a windward unit heat exchanger 'A' is connected in series to a leeward one 'B' so that a coolant discharged from the latter flows into the former.

This condenser differs from one in the first embodiment in that the coolant is caused to descend within the windward heat exchanger 'A'.

Figure 21:
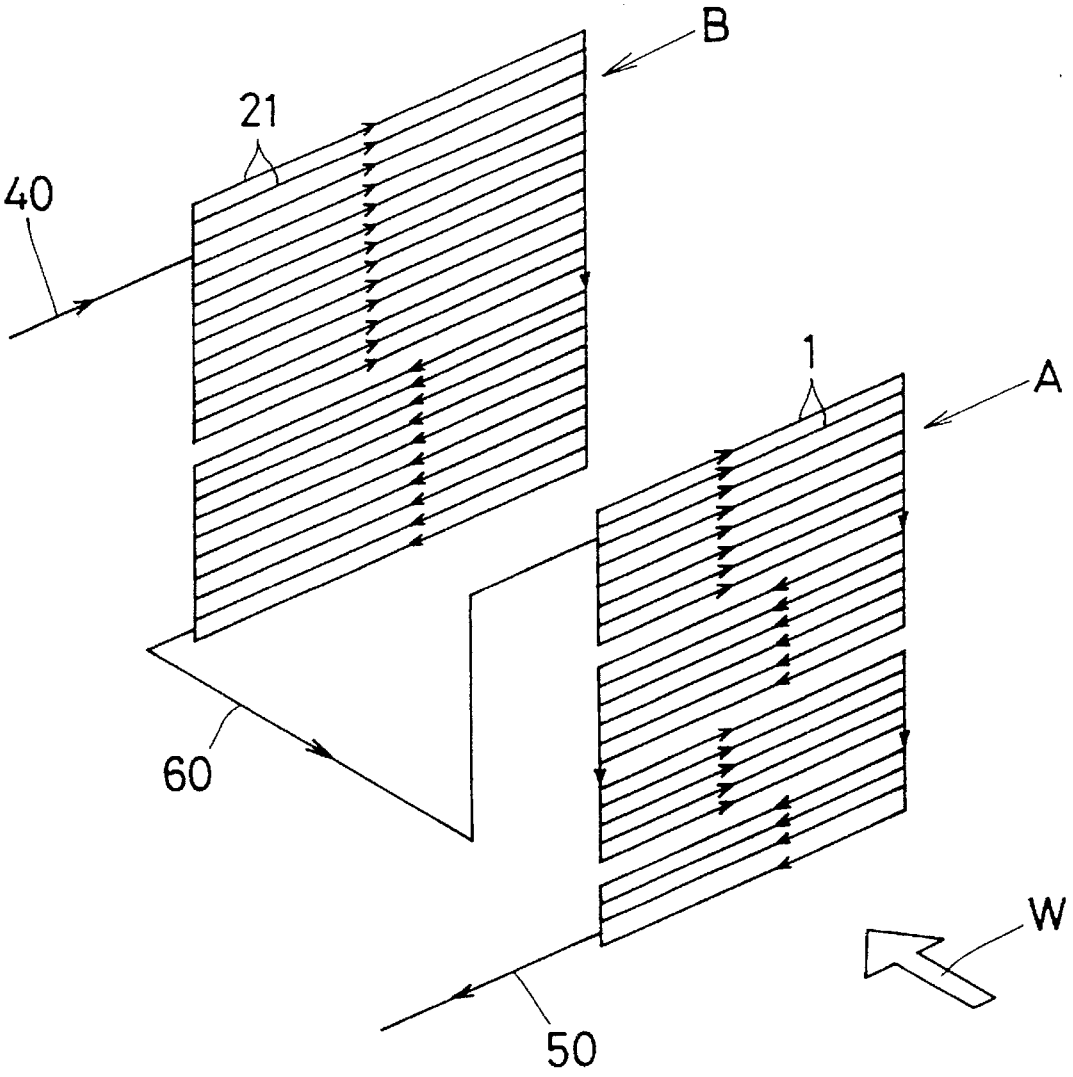

A bottom of the left-hand header 23 in the leeward heat exchanger 'B' is connected to a top of the left-hand header 3 in the windward one 'A', in fluid communication therewith through a joint pipe 60. As is shown in FIG. 21, the coolant enters the left-hand header 23 through an inlet pipe 40, meanders within the leeward heat exchanger 'B', descending into the bottom of said header 23 thereof, and transfers to the top of the header 3 of the windward heat exchanger 'A' so as to also meander therein towards the bottom of its header 3, before leaving this condenser through an outlet pipe 50.

Partition plates 9, 10 and 29 in the headers in this embodiment are positioned such that the cross-sectional area of each meandering pass composed of the tubes gradually decreases from the inlet side towards outlet side in the leeward heat exchanger 'B', and also in the windward one 'A' from inlet to outlet. The cross-sectional area depends on the number of tubes in those passes. In detail, the numbers of tubes 1 or 21 allotted to those passes are: 13, 10, 8, 6, 5 and 4, in this order from inlet to outlet. Such a gradual decrease in cross-sectional area of those passes, i.e., sequential flow paths, matches the gradual change in coolant volume much better than in the first embodiment, thus further improving the heat exchange efficiency.

Fin pitch '$Fp_B$' in the leeward heat exchanger 'B' is smaller than that '$Fp_A$' in the windward one 'A' so that a heat exchange area in contact with air flow per unit area of the former 'B' is larger than that of the latter 'A'. Such a difference between the fin pitches '$Fp_B$' and '$Fp_A$' contributes to a further improvement of heat exchange efficiency of the duplex heat exchanger as a whole, because the leeward heat exchanger 'B' can also effect a heat exchange satisfactorily between the coolant flowing therethrough and an air stream, though it has been heated in the windward unit heat exchanger 'A'.

It is recommended to adopt a value of 1.07 to 1.8 as a ratio of '$Fp_A$'/'$Fp_B$'. A ratio lower than 1.07 will result in a greater pressure loss of air flow and a lower efficiency of heat radiation. A ratio higher than 1.8 however will likewise bring about an insufficient heat radiation, though pressure loss will be decreased. A narrower range of the ratio from 1.1 to 1.6 is more preferable.

Even in a case wherein the windward and leeward unit heat exchangers are of the same core size, the ratio has to fall within the range of 1.07 to 1.8, and more desirably 1.1 to 1.6, for the reason mentioned above.

The tubes 1 and 21 in this embodiment are also the perforated 'harmonica' tubes similar to those in first embodiment, but three longitudinal partitioning walls 1*a* divide the interior of each tube into four longitudinal compartments, i.e., unit coolant paths. Such an increased number of the walls la gives a decreased hydraulic diameter of the unit paths, and their heat exchange area in contact with the coolant is expanded to improve the heat exchange efficiency. Small lugs protruding from the internal surface of each unit path further improves the efficiency.

Third Embodiment

Figure 22:
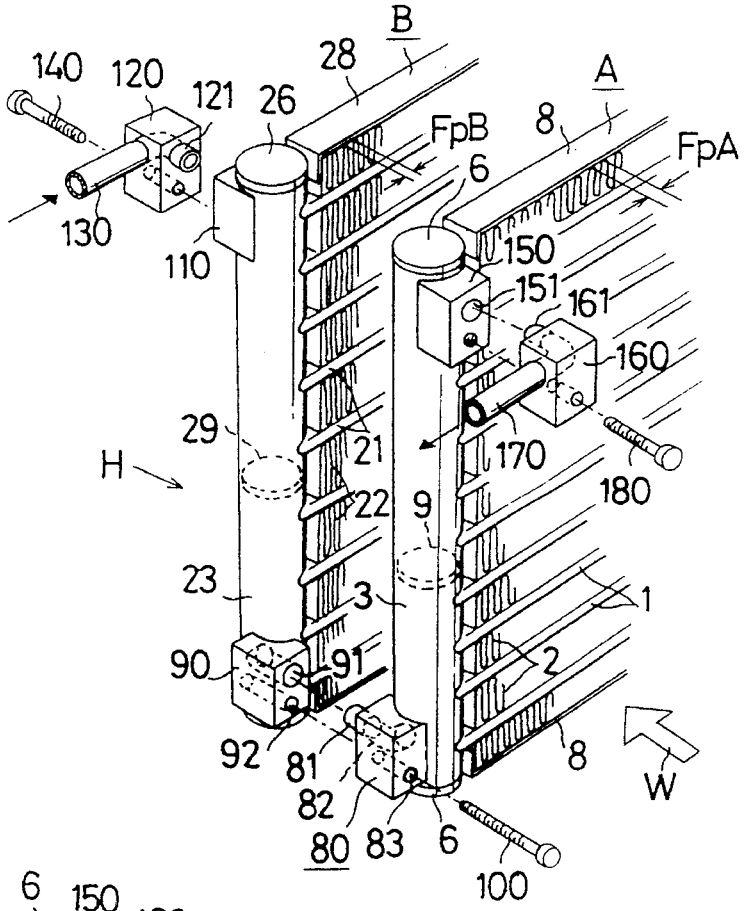
Figure 23:
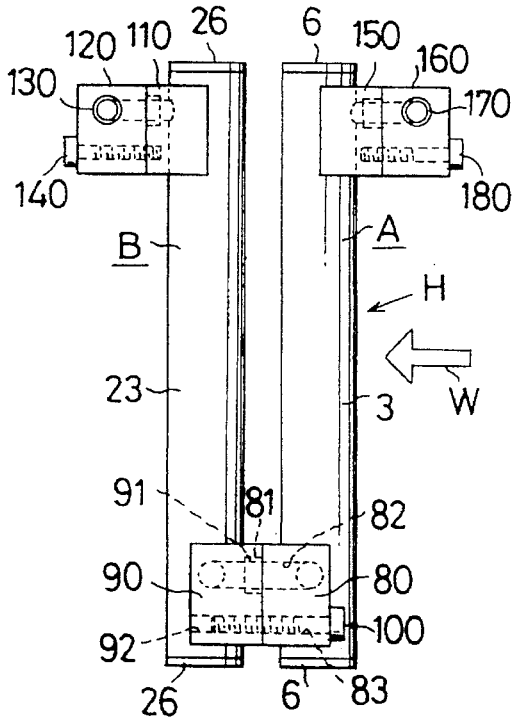
Figure 24:
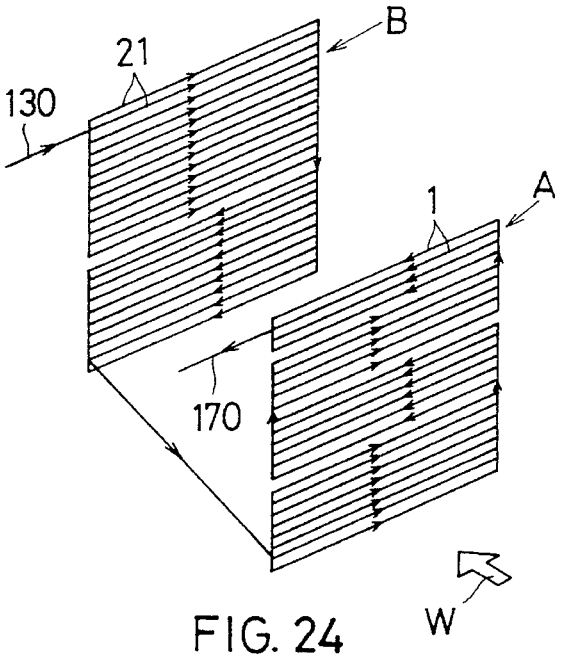

FIGS. 22 to 24 show a third embodiment of the present invention.

Similarly to the first embodiment, here is also provided a condenser, and a windward unit heat exchanger 'A' is connected in series to a leeward one 'B' so that a coolant discharged from the latter flows into the former. The same numerals are allotted to the parts such as the headers, tubes, corrugated fins and partitioning plates which are the same as those in the first embodiment, and no description thereof is repeated here.

This condenser is characterized in that its windward and leeward unit heat exchangers 'A' and 'B' are of the same size.

The fin pitch '$Fp_B$' in the leeward heat exchanger 'B' is however smaller than that '$Fp_A$' in the windward one 'A' so that a heat exchange area in contact with air flow per unit area of the former 'B' is larger than that in the latter 'A'.

The purpose and effect of such a difference in the fin pitch between the unit heat exchangers, as well as the fin pitch ratio '$Fp_A/Fp_B$' are the same as those in the second embodiment.

The windward heat exchanger 'A' is connected in fluid communication to the leeward one 'B' by joint blocks.

A male joint block 80 is welded or otherwise attached to a lowermost portion of a left-hand header 3 in the windward heat exchanger 'A'. The male block 80 has a lug 81 protruding from its inner side, and a coolant passage 82 is formed through the lug 81 and in fluid communication with the left-hand header 3.

On the other hand, a female joint block 90 is fixed to a lowermost portion of the left-hand header 23 in the leeward heat exchanger 'B'. An aperture 91 is formed at inner side of and through the female block so as to be likewise in fluid communication with the left-hand header 23. To combine the male block 80 with the female block 90, the lug 81 is engaged with the aperture 91 so that the inner sides of those blocks are brought into close contact with each other. Then, a bolt 100 will be inserted through a hole 83 of the male block 80 and fastened into an internally-threaded hole 92 of the female block 90. In this way, the coolant paths in the windward and leeward unit heat exchangers 'A' and 'B' are connected in series.

An inlet block 110 having a hole is fixed to an uppermost portion of the leeward heat exchanger 'B'. A pipe attaching block 120, which has a lug 121 and an attached inlet pipe 130, is mounted on the inlet block 110 by engaging the hole thereof with the lug 121. A bolt 140 fastens the pipe attaching block 120 to the inlet block 110.

Similarly, an outlet block 150 having a hole 151 is fixed to an uppermost portion of the left-hand header 3 in the windward heat exchanger 'A'. A pipe attaching block 160, which has a lug 161 and an attached outlet pipe 170, is mounted on the outlet block 150, also by engaging the hole 151 thereof with the lug 161 so that a bolt 180 fastens the pipe attaching block 160 to the outlet block 150.

Such a connection using the joint and other blocks as employed herein is advantageous in that the windward and leeward unit heat exchangers 'A' and 'B' can be manufactured separate, and can individually and independently be inspected of coolant leakage before simple and final assemblage. Thus, operations and productivity in manufacturing the duplex heat exchanger are improved to a remarkable degree.

FIG. 24 shows that similarly to the second embodiment the meandering passes each composed of the tubes have a cross-sectional area, which gradually decreases from the inlet towards outlet side in the leeward heat exchanger 'B', and likewise in the windward one 'A' from inlet to outlet. The purpose and effect of such an arrangement are the same as it is in the second embodiment.

Fourth Embodiment

Figure 25:
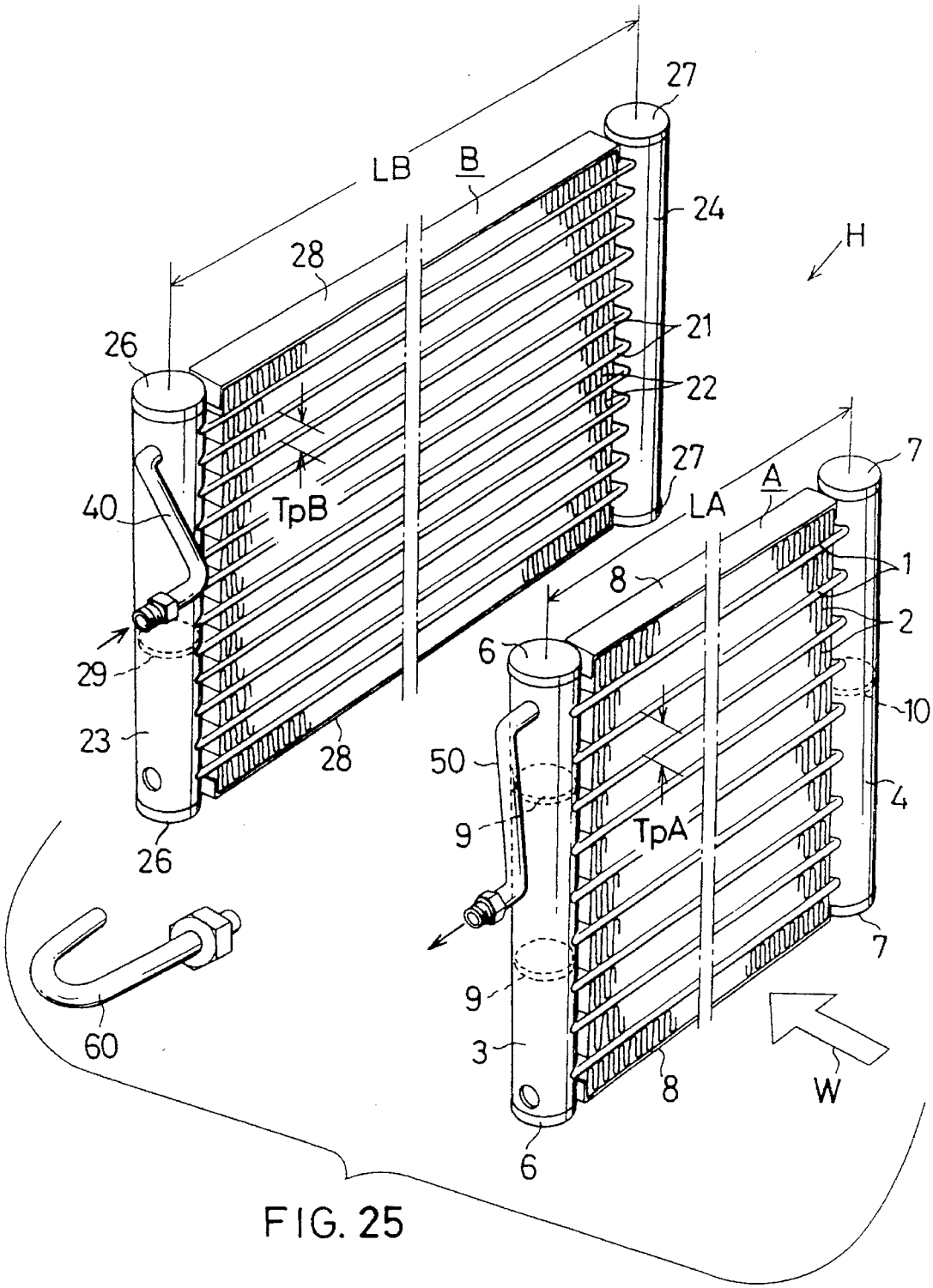
Figure 26:
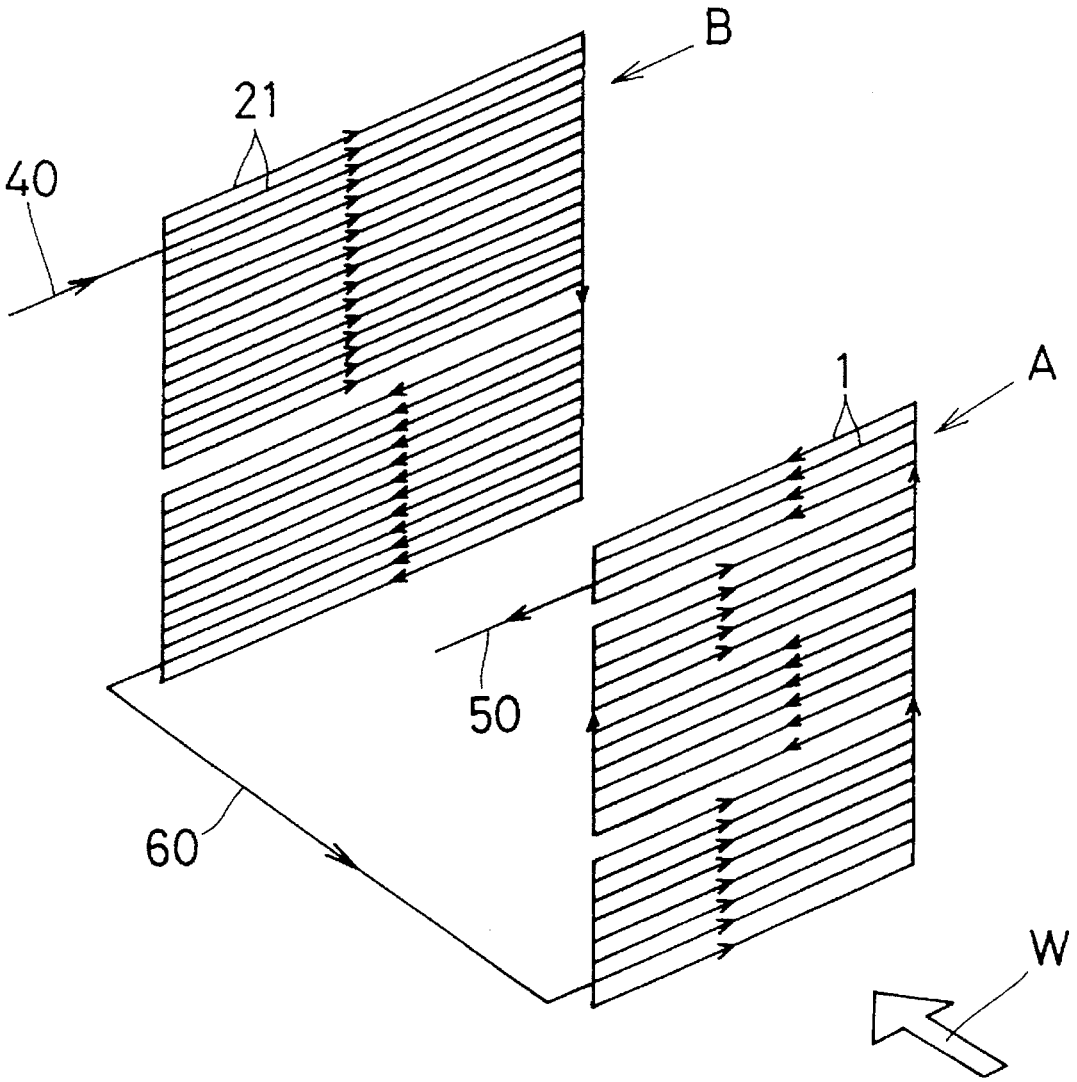
Figure 27:
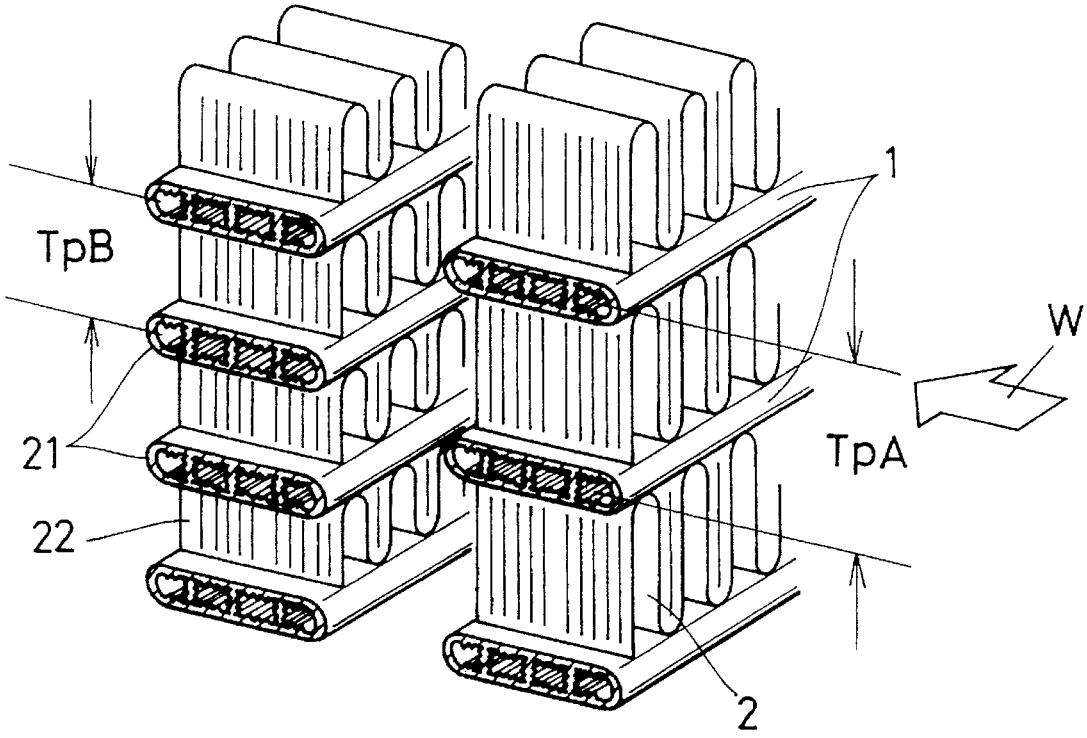

FIGS. 25 to 27 show a fourth embodiment of the present invention.

Structure of a condenser in this embodiment is similar to that in the first embodiment, except for the point referred to below. Its windward unit heat exchanger 'A' is connected in series to its leeward one 'B' so that a coolant discharged from the latter flows into the former. Therefore, the same numerals are allotted to the parts which have the same names as those in the first embodiment, and no description thereof is repeated here.

The condenser in this embodiment is characterized in that its tube pitch '$Tp_B$' in the leeward heat exchanger 'B' is smaller than that '$Tp_A$' in the windward one 'A' so that a heat exchange area in contact with air flow per unit area of the former 'B' is larger than that in the latter 'A'.

The purpose and effect of such a difference in the tube pitch between the unit heat exchangers, as well as the tube pitch ratio '$Tp_A/Tp_B$' are the same as those in the second and third embodiments.

Similarly to those in second embodiment, the tubes 1 and 21 are perforated and extruded profiles.

Fifth Embodiment

Figure 28:
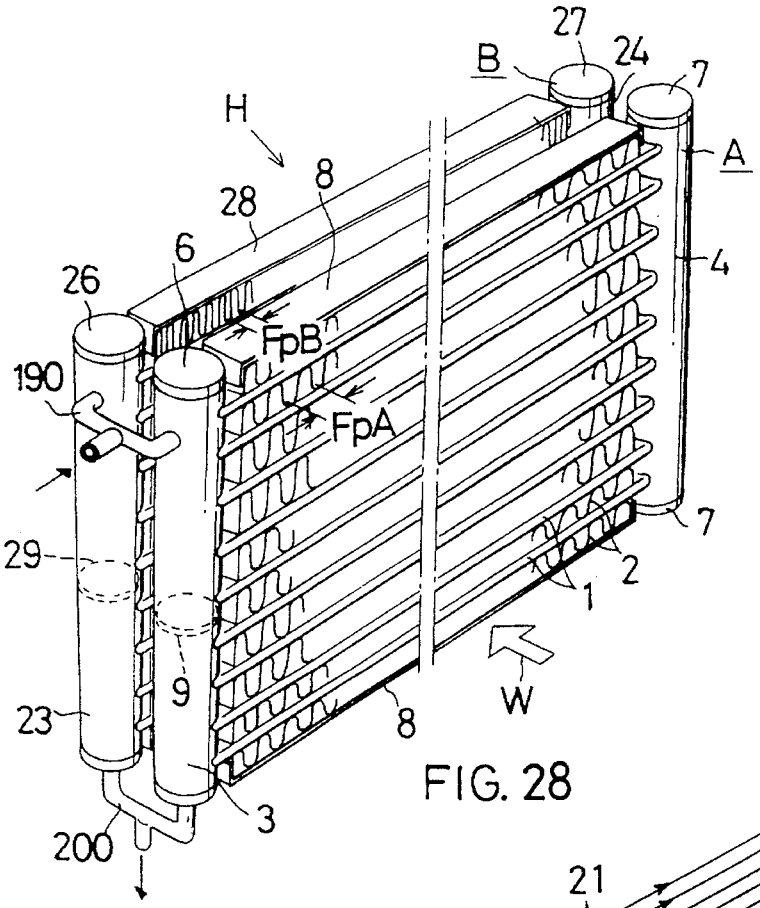
Figure 29:
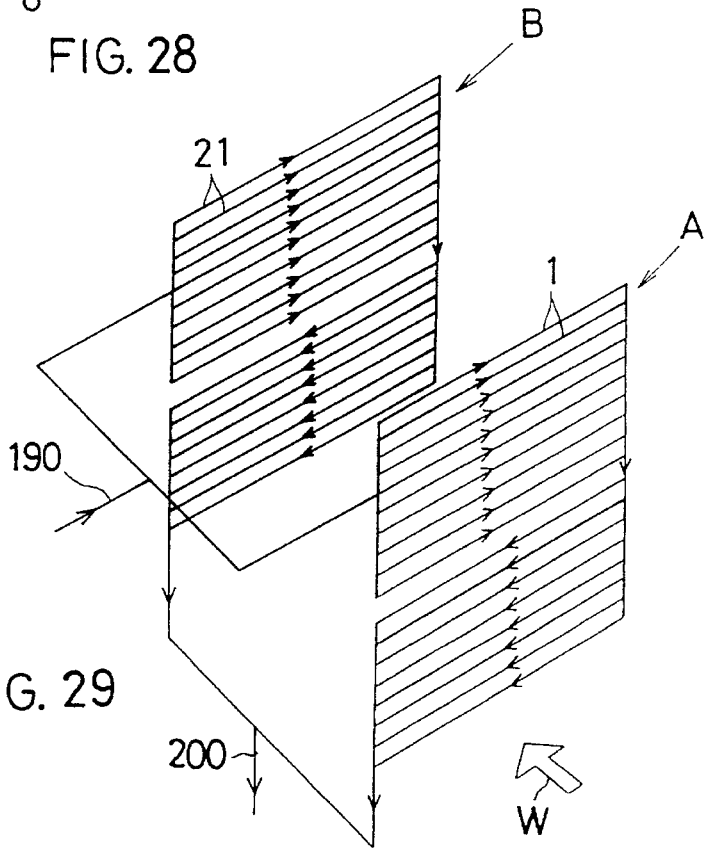
Figure 30:
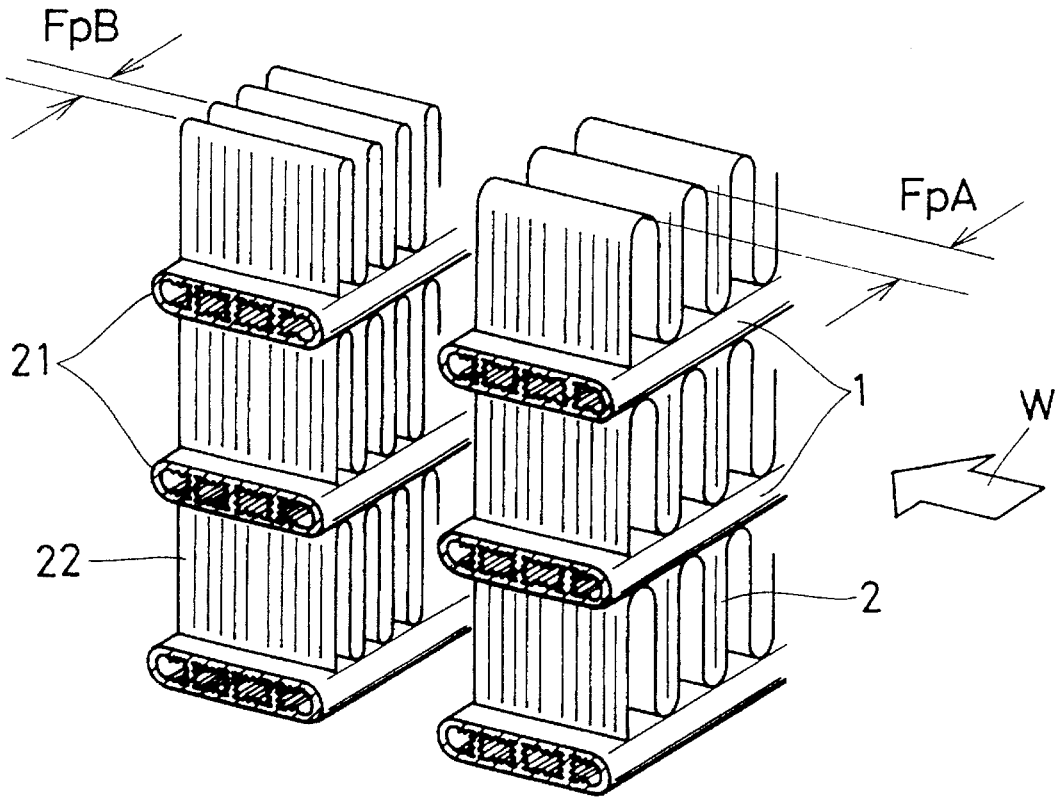

FIGS. 28 to 30 show a fifth embodiment of the present invention.

In a condenser provided in this embodiment, a windward unit heat exchanger 'A' and a leeward one 'B' are of the same size. The windward heat exchanger 'A' is combined with the other 'B' such that their coolant flow paths are connected in parallel with one another.

A bifurcate inlet pipe 190 for supplying a coolant is connected to uppermost portions of left-hand headers 3 and 23, which are in the windward and leeward unit heat exchangers 'A' and 'B', respectively. A bifurcate outlet pipe 200 is connected to bottoms of the left-hand headers 3 and 23. A partition plate 9 is secured in and at a middle height of the windward left-hand header 3, with another partition plate 29 being secured in the leeward left-hand header 23 at its middle height.

Those partition plates 9 and 29 cause the coolant, which has entered the unit heat exchangers 'A' and 'B' through the inlet pipe 190, to make one U-turn within the respective heat exchangers before arriving at both the lower chambers of the headers 3 and 23 and leaving same through the outlet pipe 200, as shown in FIG. 29. Similarly to the second and third embodiments, fin pitch '$Fp_B$' in the leeward heat exchanger 'B' is smaller than that '$Fp_A$' in the windward one 'A' so that a heat exchange area in contact with air flow per unit area of the former 'B' is larger than that of the latter 'A'. Such a relationship between the fin pitches '$Fp_B$' and '$Fp_A$' enables the coolant tributary through the leeward unit heat exchanger 'B' to be cooled well into its 'sub-cooled' before discharged therefrom, even by an air flow which has been heated in the windward heat exchanger 'A'. Thus, both the tributaries flowing through the two heat exchangers are sub-cooled, before they join one another.

A recommendable ratio '$Fp_A$'/'$Fp_B$' is the same as in the preceding embodiments.

The other feature or structural elements are the same as those in the second embodiment. Therefore, the same numerals are assigned to the corresponding parts and no description thereof is repeated.

Although only one partition plate 9 or 29 is secured in each of the left-hand headers 3 and 23 at the middle height thereof, the position of those partition plates may be altered. Additional partition plates may be secured also in the right-hand headers 4 and 24 so that the coolant makes two or more U-turns within each of the unit heat exchangers 'A' and 'B'. In this alternative case, the cross-sectional area of the coolant passes may preferably be decreased in a gradual manner.

Sixth Embodiment

Figure 31:
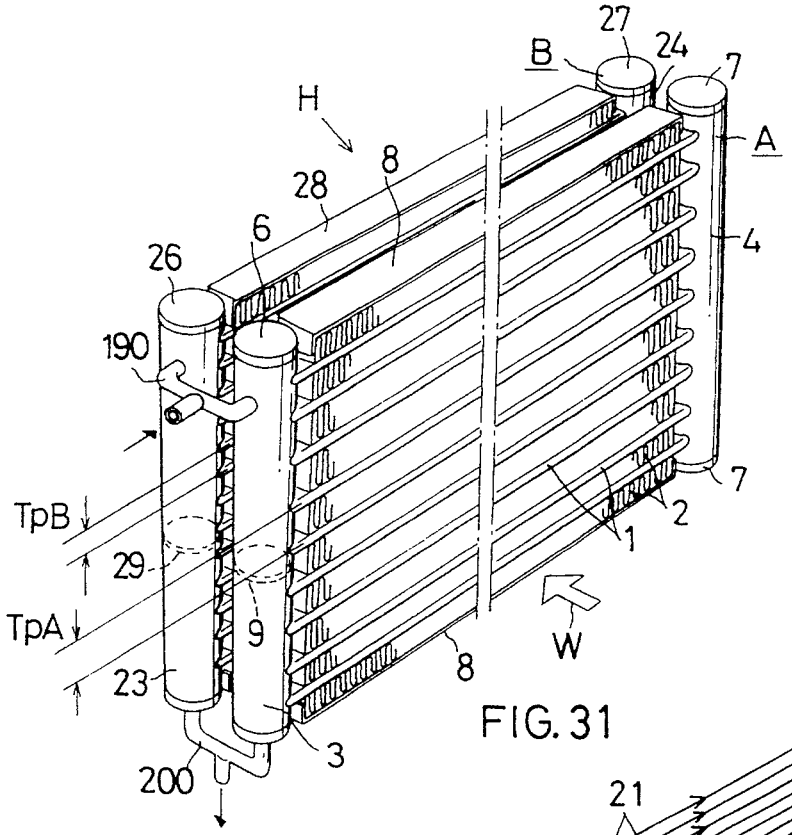
Figure 32:
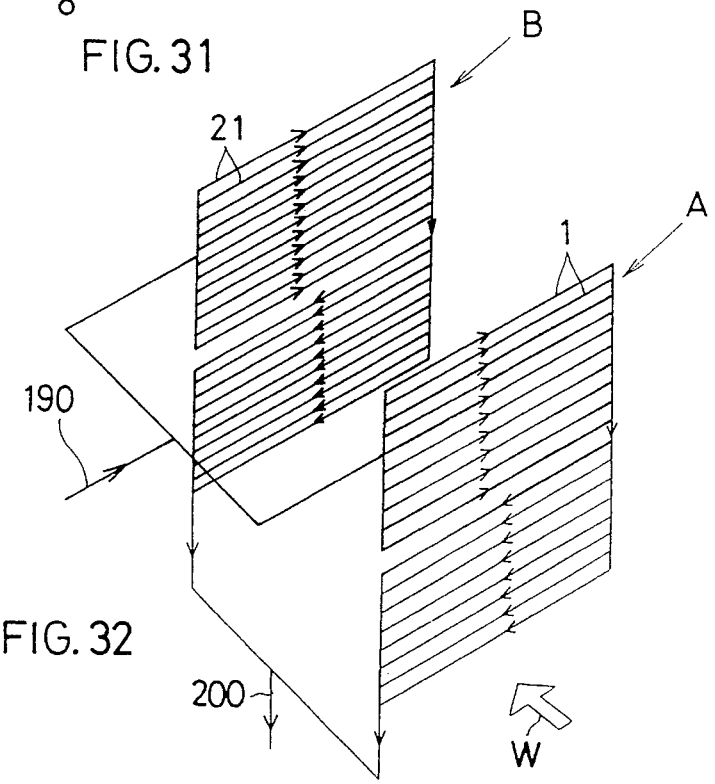
Figure 33:
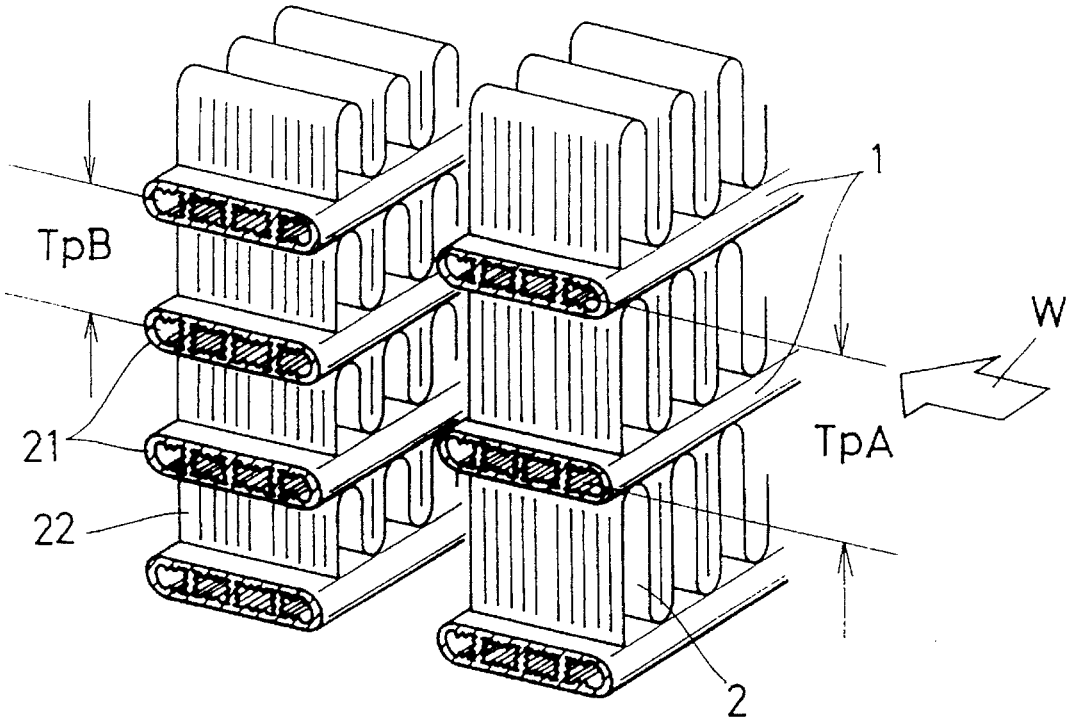

FIGS. 31 to 33 show a sixth embodiment of the present invention.

Also in a condenser provided in this embodiment, a windward unit heat exchanger 'A' and a leeward one 'B' are of the same size and same shape. Similarly to the fifth embodiment, the former unit heat exchanger 'A' is combined with the latter 'B' such that their coolant flow paths are connected in parallel with one another.

However in the six embodiment, tube pitch '$Tp_B$' in the leeward heat exchanger 'B' is smaller than that '$Fp_A$' in the windward one 'A' so that a heat exchange area in contact with air flow per unit area of the former 'B' is larger than that of the latter 'A'. An effect of this arrangement is the same as that of the arrangement employed in the fifth embodiment.

In detail, such a relationship given between the tube pitches '$Tp_B$' and '$Tp_A$' also enables the coolant tributary through the leeward heat exchanger 'B' to be cooled well into its 'sub-cooled' state before discharged, even by an air flow which has been heated in the windward heat exchanger 'A'. Thus, both the coolant tributaries flowing through the two heat exchangers are sub-cooled, before joining one another.

The other feature or structural elements are the same as those in the fifth embodiment. Therefore, the same numerals are allotted to the corresponding parts and no description thereof is repeated.

The position and number of the partition plates may be altered, if it is necessary for the coolant to make two or more U-turns within each of the heat exchangers 'A' and 'B'. In this alternative case, the cross-sectional area of the coolant passes may preferably be decreased in a gradual manner.

Seventh Embodiment

Figure 34:
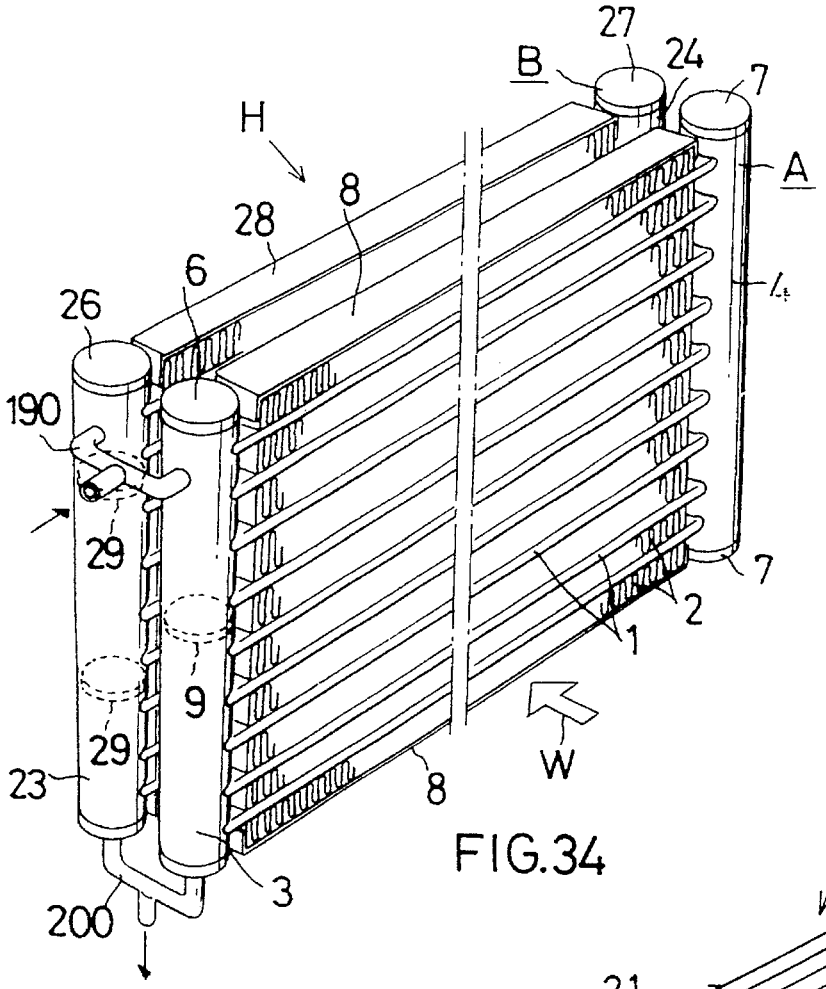
Figure 35:
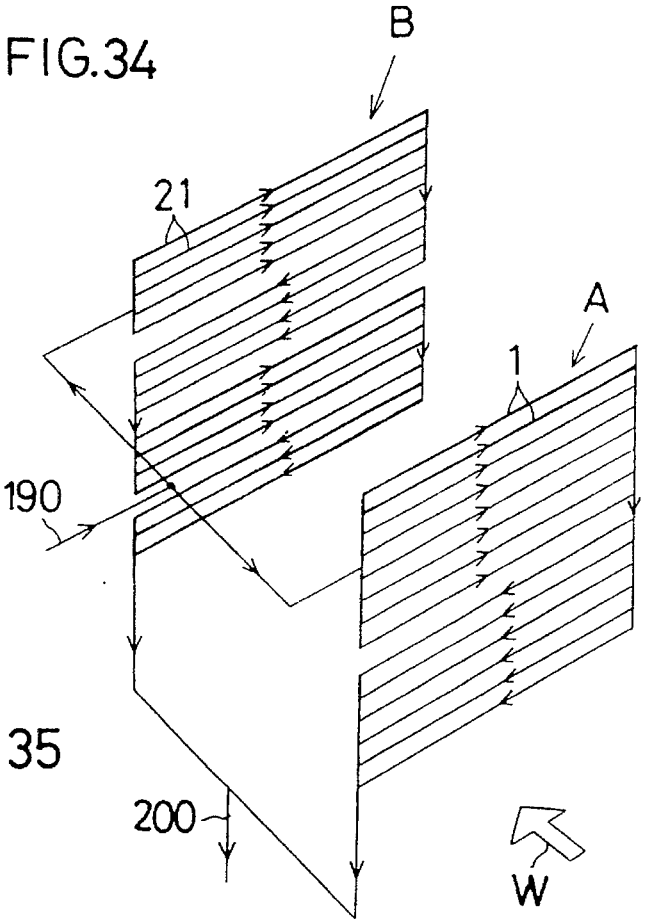

FIGS. 34 and 35 show a seventh embodiment of the present invention.

Also in a condenser provided in this embodiment, a windward unit heat exchanger 'A' and a leeward one 'B' are of the same size. Similarly to the fifth and sixth embodiments, the former heat exchanger 'A' is combined with the latter 'B' such that their coolant flow paths are connected in parallel with one another.

However in contrast with the fifth and sixth embodiments, tube pitch and fin pitch in the windward unit heat exchanger 'A' are the same as those in the leeward one 'B' in the present embodiment.

Further, the condenser provided in this embodiment is characterized in that one partition plate 9 is secured in and at a middle height of the windward left-hand header 3, while one of two partition plates 29 is disposed above a middle height of the leeward left-hand header 23, with the other 29 being below the middle height. Still another partition plate (not shown) is secured also at a middle height of the leeward right-hand header 24.

Due to such an arrangement of the partition plates, a coolant tributary which has entered the windward heat exchangers 'A' will make one U-turn therein, whereas another tributary makes having entered the leeward one 'B' makes three U-turns therein. Both the tributaries will then be collected in the lower chambers of those left-hand headers 3 and 23, before flowing out of this condenser through the outlet pipe 200.

More U-turns made by the coolant in the leeward heat exchanger 'B' than in the windward one 'A' are intended to compensate a less amount of heat transfer per unit time in the other heat exchanger 'B' lying leeward. In other words, the leeward heat exchanger 'B' provides an overall coolant passageway which is longer than that the windward one does, whereby the amount of heat exchanged in one of the unit heat exchangers is made almost equal to that in the other one.

Thus, the coolant tributary through the leeward heat exchanger 'B' can be cooled well into its 'sub-cooled' state before discharged, even by an air flow which has been heated in the windward heat exchanger 'A'. Both the coolant tributaries cooled in the two heat exchangers will be in their sub-cooled state when flowing out of same to join one another.

The other feature or structural elements are the same as those in the fifth and sixth embodiments. Therefore, the same numerals are allotted to the corresponding parts and no description thereof is repeated.

It is also desirable that the cross-sectional area of the coolant passes is decreased from the inlet towards the outlet in a gradual manner.

Additionally, in a modification of this embodiment, the fin pitch and/or the tube pitch in one of the windward and leeward heat exchangers are made different from those in the other in a manner described in the fifth and/or sixth embodiments, together with the more U-turns in the leeward one.

Eighth Embodiment

Figure 36:
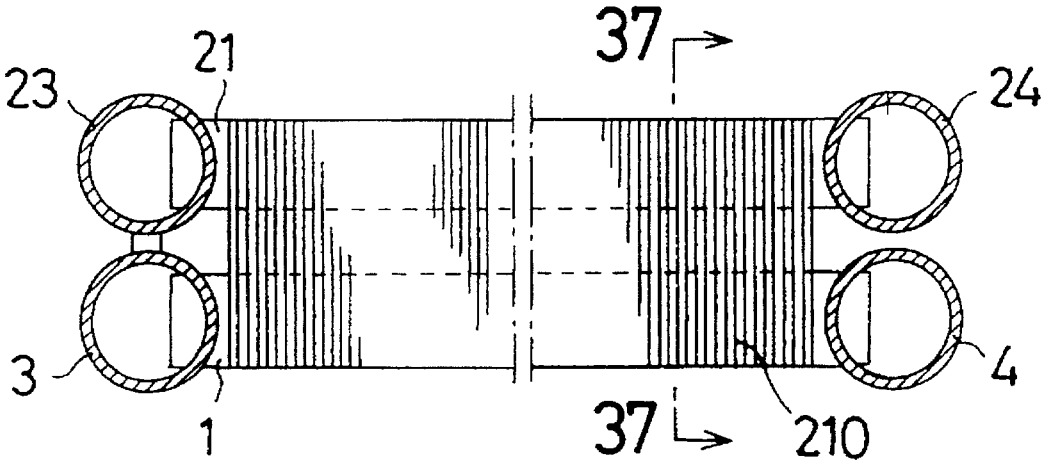
Figure 37:
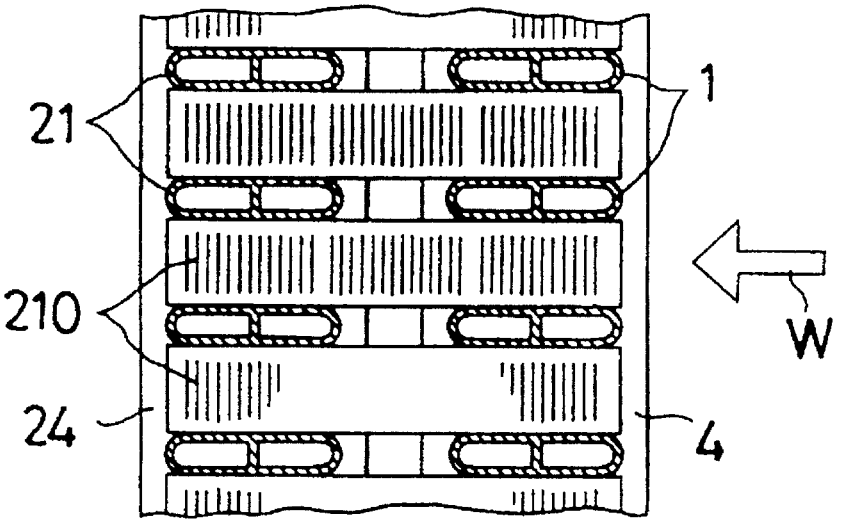

FIGS. 36 and 37 show an eighth embodiment of the present invention.

All the features except for the structure of fins in this embodiment are the same as those in the seventh embodiment. Thus, the same reference numerals are allotted to the corresponding parts and no description thereof is repeated.

The condenser in this embodiment is characterized in that wide corrugated fins 210 each extend from the windward heat exchanger 'A' to the leeward one 'B' so as to span them. This structure enables direct connection between cores of said heat exchangers 'A' and 'B', thereby improving their overall heat transfer efficiency. Mechanical strength of connection also is enhanced so that only one of them need be secured to an automobile body or the like. This reduces the number of parts which are necessary in mounting this duplex heat exchanger on said objects, and thereby improves the productivity of said duplex heat exchanger.

Ninth Embodiment

Figure 38:
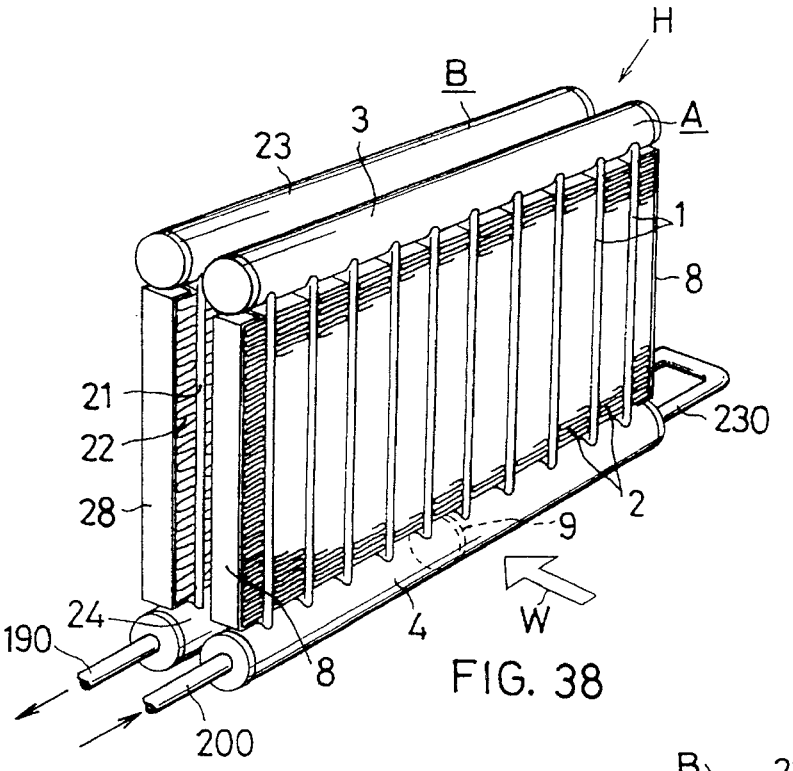
Figure 40:
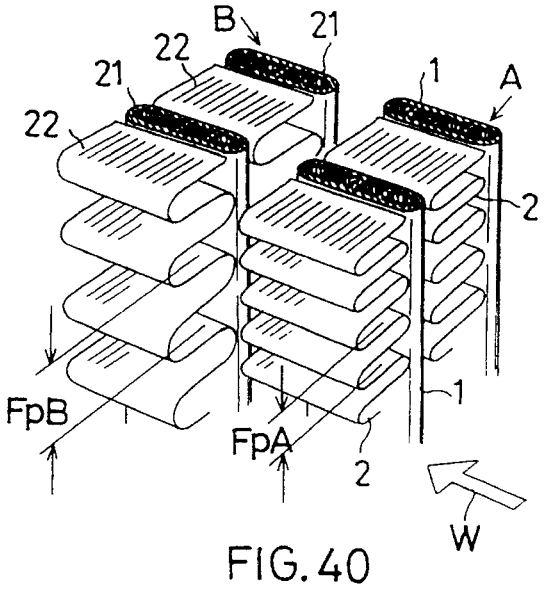
Figure 39:
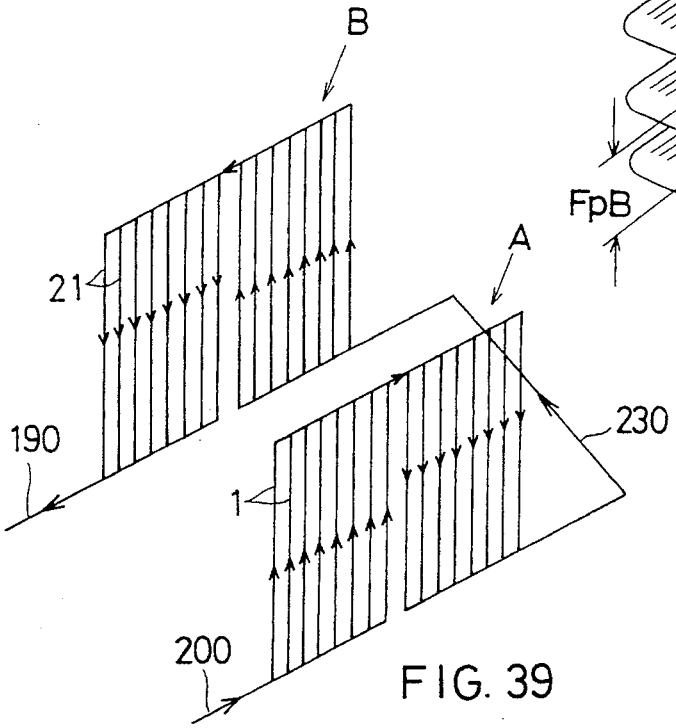

FIGS. 38 to 40 show a ninth embodiment of the present invention applied to an evaporator for use in car coolers.

Tubes 1 and 21 are all disposed vertical from left to right and in parallel with each other, in each of the windward unit heat exchanger 'A' and the leeward one 'B', both constituting this evaporator. Headers 3, 4, 23 and 24 lie horizontal and one above the other.

A bifurcate joint pipe 230 is connected to right-hand ends of the lower headers 4 and 24. A coolant inlet pipe 200 is connected to a left-hand end of one of the lower headers 4, with an outlet pipe 190 being connected to a left-hand end of the other lower header 24. Thus, a coolant circuit through the windward heat exchanger 'A' is formed in series to that through the leeward one 'B'.

In operation, a coolant will enter the lower header 4 of the windward heat exchanger 'A' through the inlet pipe 200, and then ascend through a left-hand group of the tubes 1 and into the upper header 3 since those tubes are separated by a partition plate 9 from a right-hand group thereof. The coolant will subsequently make a U-turn within the upper header 3 so as to descend through the right-hand group of tubes 1 and return into the lower header 4, before advancing into the lower header 24 of the leeward heat exchanger 'B' through joint pipe 230. The coolant which has entered the heat exchanger 'B' will then ascend through a right-hand group of the tubes 21 separated by a partition plate (not shown) from a left-hand one, and make a U-turn in the upper header 23 so as to descend through said left-hand group of the tubes 21, before flowing into the lower header 24 and flowing out of it through the outlet pipe 190.

As will be seen in FIGS. 38 and 40, a fin pitch '$Fp_B$' in each corrugated fin 22 in the leeward heat exchanger 'B' is greater than that '$Fp_A$' in each corrugated fin 2 in the windward one 'A'. This means that unit air flow paths each defined between the adjacent tubes in the leeward heat exchanger 'B' are larger than those in the windward one 'A'.

Such a greater fin pitch '$Fp_B$' in the leeward heat exchanger 'B' is effective to prevent the so-called problem of 'water-drop-flying'. This problem, inherent in the prior art evaporators, has been caused heretofore by a violent air flow through between the fins 22 to scatter the condensed water from the leeward heat exchanger 'B' towards an automobile cabin.

Details of the structural elements of the unit heat exchangers 'A' and 'B' are the same as those in the preceding embodiments to which the same reference numerals are allotted, and no description thereof is repeated.

Tenth Embodiment

Figure 41:
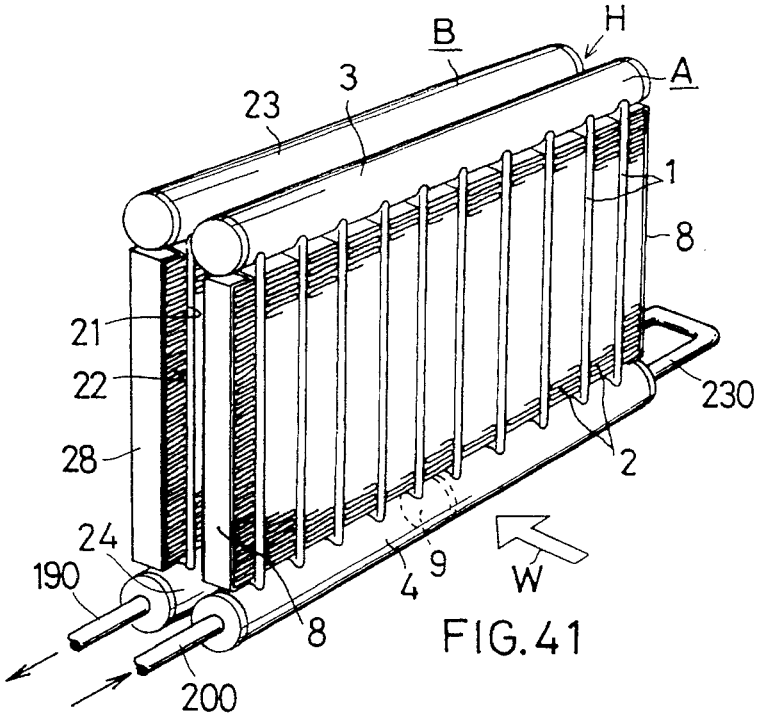
Figure 42:
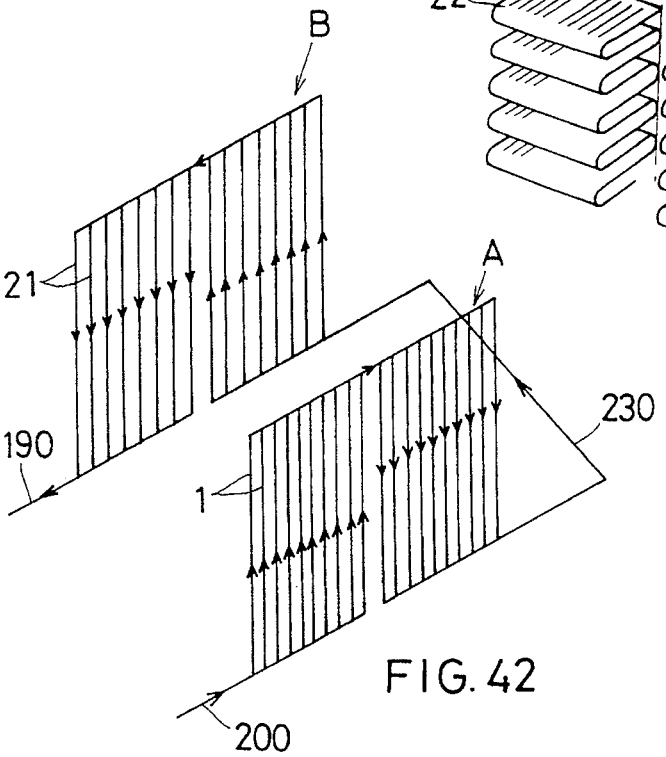
Figure 43:
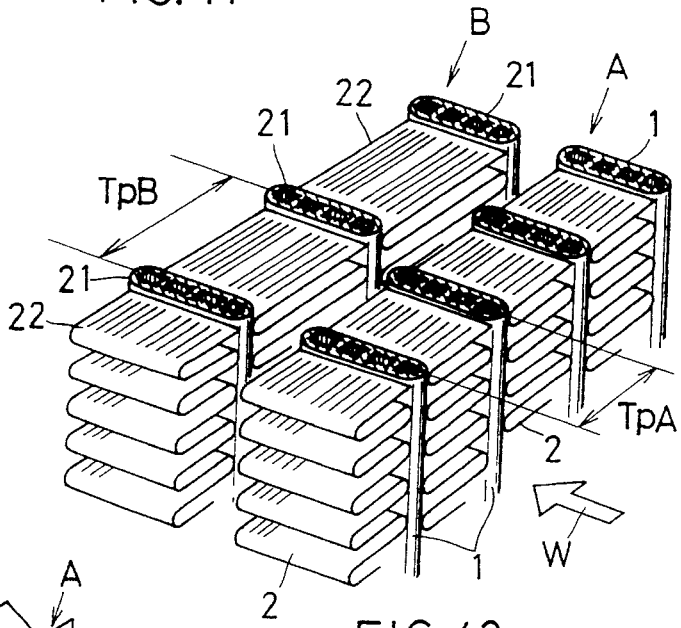

FIGS. 41 to 43 show a tenth embodiment of the invention also applied to an evaporator for car coolers.

Its features, other than the structure of cores each comprising the tubes and fins in unit heat exchangers 'A' and 'B', are the same as those in the ninth embodiment. The same reference numerals are allotted to the corresponding elements of which no description is made.

As seen in FIG. 43, this evaporator is characterized in that a tube pitch '$Tp_B$' in the leeward heat exchanger 'B' is greater than that '$Tp_A$' in the windward one 'A', whereby unit air flow paths each defined between the adjacent tubes in the former 'B' are larger than those in the latter 'A'. Due to such a greater tube pitch '$Tp_B$' in the leeward heat exchanger 'B', the air flow through the fins between the adjacent tubes is also prevented herein from causing the so-called 'water-drop-flying' from the leeward heat exchanger towards the automobile cabin.

Eleventh Embodiment

Figure 44:
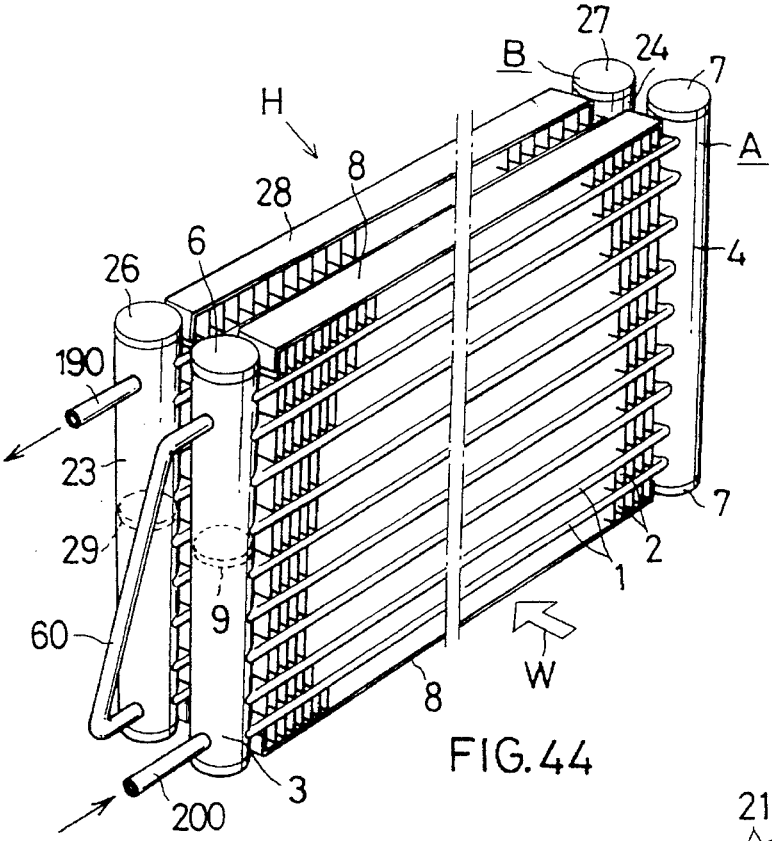
Figure 45:
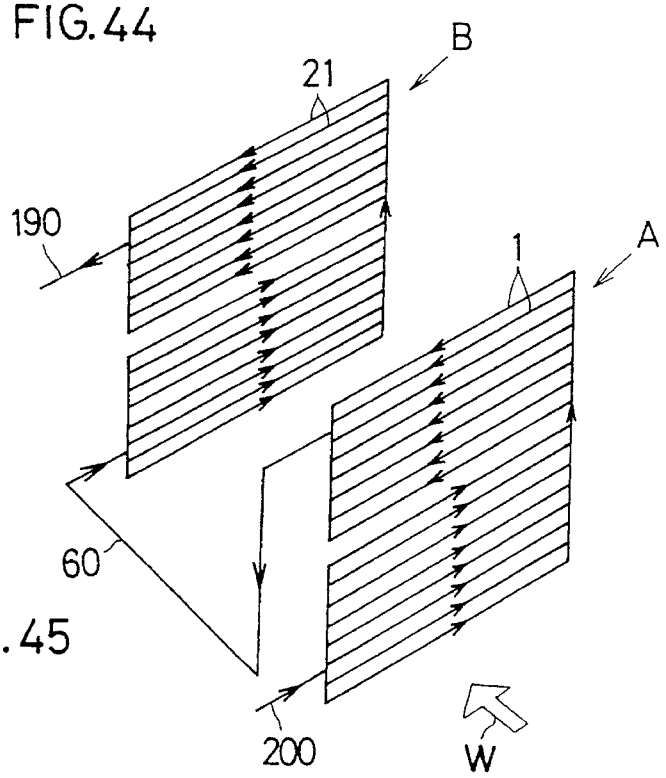
Figure 46:
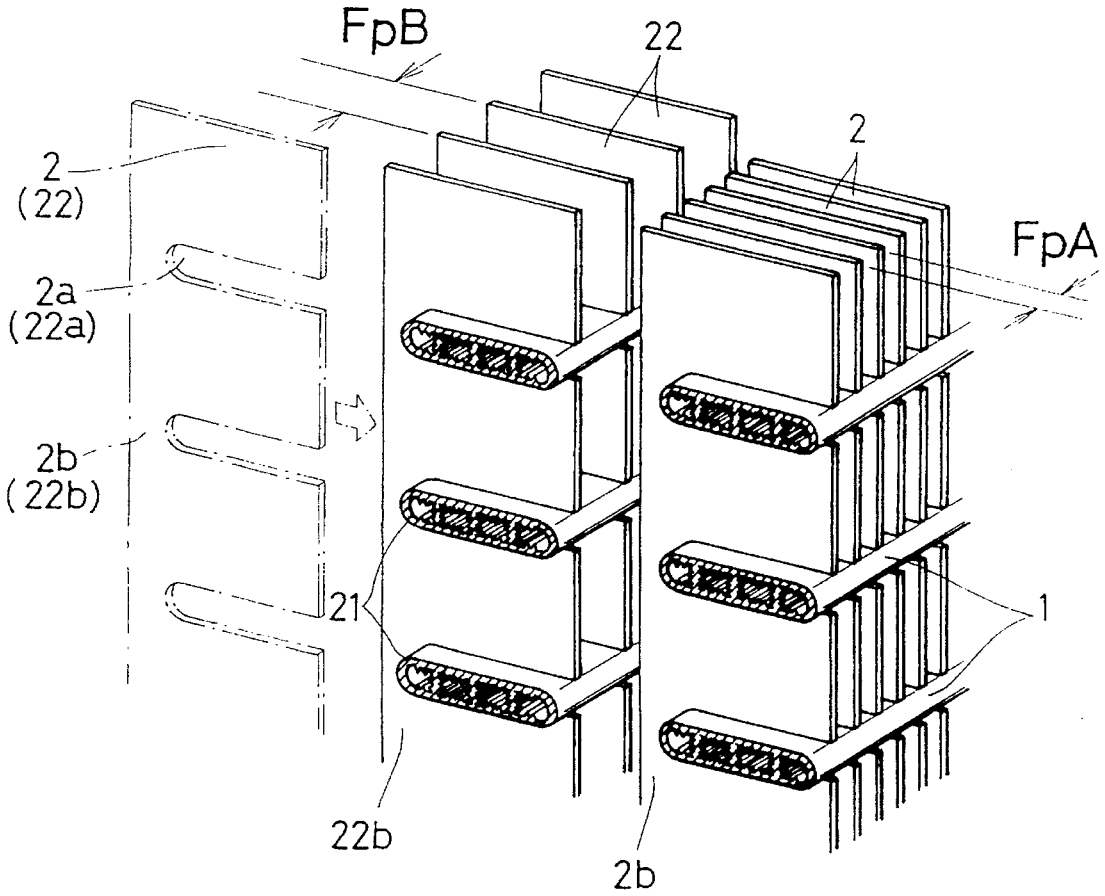

FIGS. 44 to 46 show an eleventh embodiment of the invention also applied to an evaporator for car coolers.

This duplex heat exchanger 'H' as the evaporator does comprise also a windward unit heat exchanger 'A' and a leeward one 'B' which are arranged fore and aft in the direction 'W' of air flow.

Each of the unit heat exchangers 'A' and 'B' is composed of: a plurality of horizontal tubes 1 or 21 which are disposed one above another; fins 2 or 22 each interposed between the two adjacent tubes; and a left-hand and right-hand vertical headers 3 and 4, or 23 and 24. The tubes and headers are the same as those in the preceding embodiments, and the same numerals are allotted thereto to abbreviate description thereof.

However, each of the fins 2 and 22 is a strip which has a plurality of cutouts 2*a* or 22*a* formed at regular intervals along one of its longitudinal sides, in a manner as shown in FIG. 46. Each of those cutouts 2*a* and 22*a* is of a shape fittable on the tube, and the other longitudinal side of each strip as the fin has no cutouts so as to serve as a 'tie bar' 2*b* or 22*b*. Those strips are disposed vertical and in parallel with one another, such that their longitudinal sides each having the cutouts fitting on the tubes do face the windward. The tie bars 2*b* and 22*b*, which protrude rearwardly of the tubes, facilitate the drainage of condensed water produced on the fins 2 and 22 and the tubes 1 and 21.

Partition plates 9 and 29 are secured respectively in the left-hand headers 3 and 23 of the unit heat exchangers 'A' and 'B', at a middle height of each header so that their interiors are divided into an upper and lower chambers.

A joint pipe 60 connects the lower chamber of left-hand header 23 in the leeward heat exchanger 'B' to the upper chamber of the left-hand header 3 in the windward one 'A'. A coolant circuit which is formed through the windward heat exchanger 'A' is thus in series to that formed through the leeward one 'B'.

A coolant outlet pipe 190 is attached to an upper portion of the left-hand header 23 in the leeward heat exchanger 'B', whilst an inlet pipe 200 is attached to a lower portion of left-hand header 3 in the windward one 'A'.

FIG. 45 illustrates a flow of coolant through this evaporator. The coolant will enter at first the windward heat exchanger 'A' through its inlet pipe 200, and subsequently make a U-turn to return to the upper chamber of left-hand header 3. The coolant will advance into the lower chamber of left-hand header 23 in the leeward heat exchanger 'B' so that it likewise makes a U-turn before collected in the upper chamber of said header 23 and discharged therefrom through the outlet pipe 190.

As will be seen in FIGS. 44 and 46, and similarly to the ninth embodiment, a fin pitch '$Fp_B$' between the fins 22 in the leeward heat exchanger 'B' is greater than that '$Fp_A$' between the fins 2 in the windward one 'A'. This means that unit air flow paths each defined between the adjacent tubes in the leeward heat exchanger 'B' are considerably larger than those in the windward one 'A'.

In the same manner as the ninth and tenth embodiments, the greater fin pitch '$Fp_B$' in the leeward heat exchanger 'B' is effective to prevent the so-called 'water-drop-flying' therefrom which has been inherent in the prior art evaporators.

Twelfth Embodiment

Figure 47:
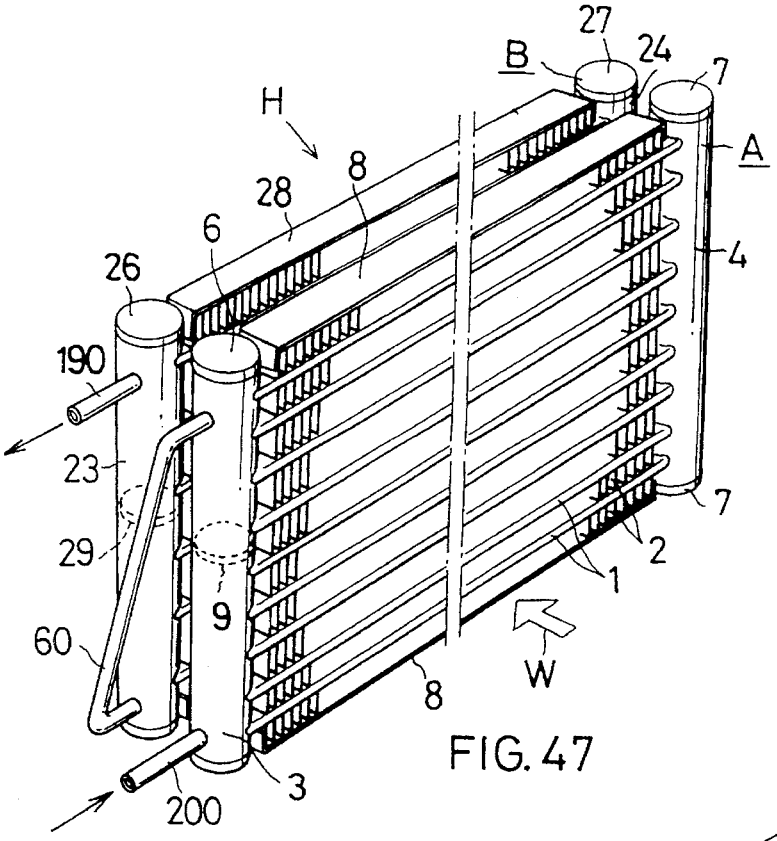
Figure 48:
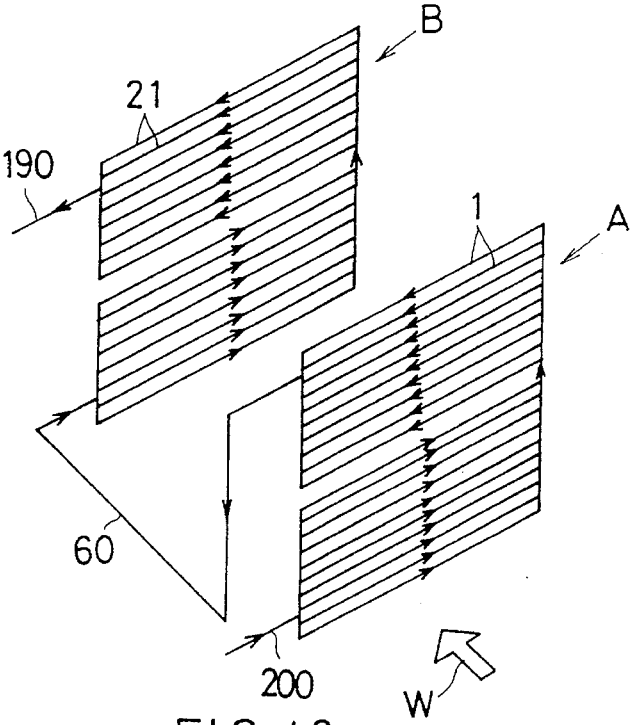
Figure 49:
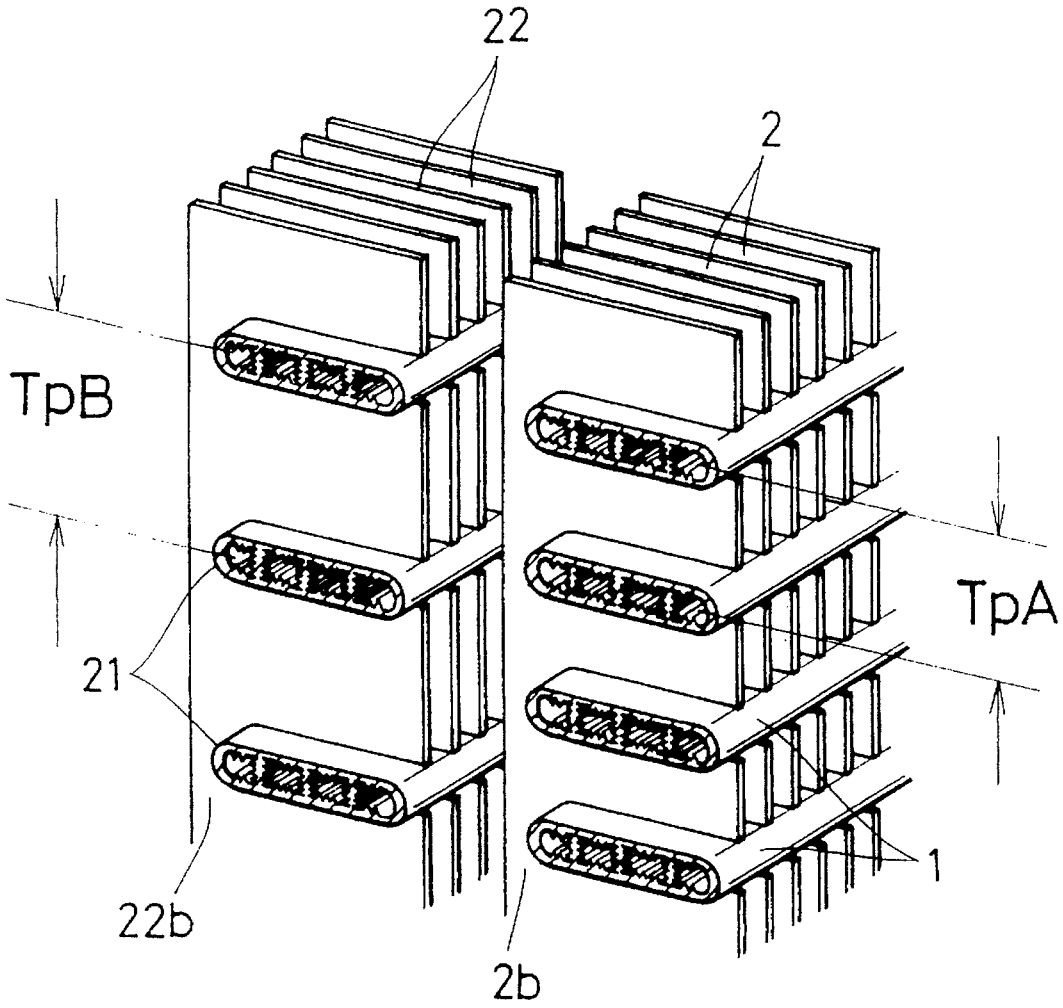

FIGS. 47 to 49 show a twelfth embodiment of the invention also applied to an evaporator for car coolers.

Features of this duplex heat exchanger 'H', except for fin pitch and tube pitch, are the same as those which are described in the eleventh embodiment. The same reference numerals are allotted to the corresponding elements of which no description is given.

The fin pitch in the windward heat exchanger 'A' in this embodiment is the same as that in the leeward one However, the tube pitch in the leeward heat exchanger 'B' is greater than that which windward one 'A' has as shown in FIG. 49. Therefore, unit air flow paths each defined between the adjacent tubes and separated by the fins in the leeward heat exchanger 'B' are considerably larger than those in the windward one 'A'.

Similarly to the ninth to tenth embodiments, the problem of 'water-drop-flying' from the leeward heat exchanger is resolved also in this embodiment.

Thirteenth Embodiment

Figure 50:
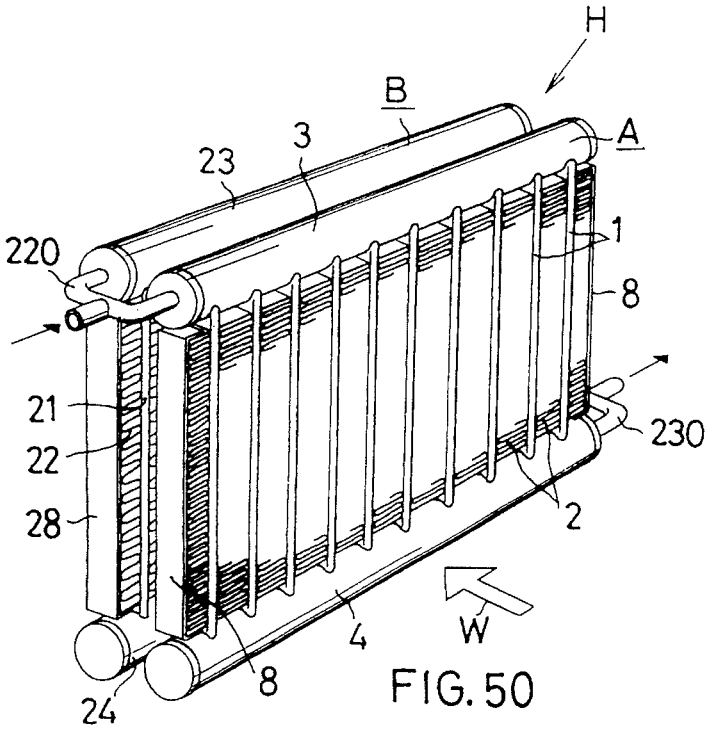
Figure 52:
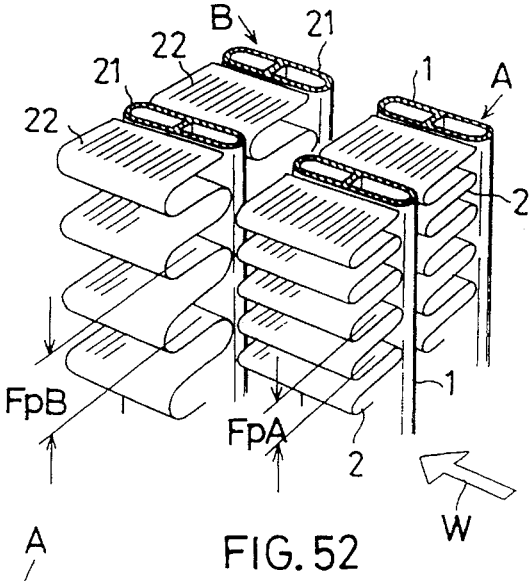
Figure 51:
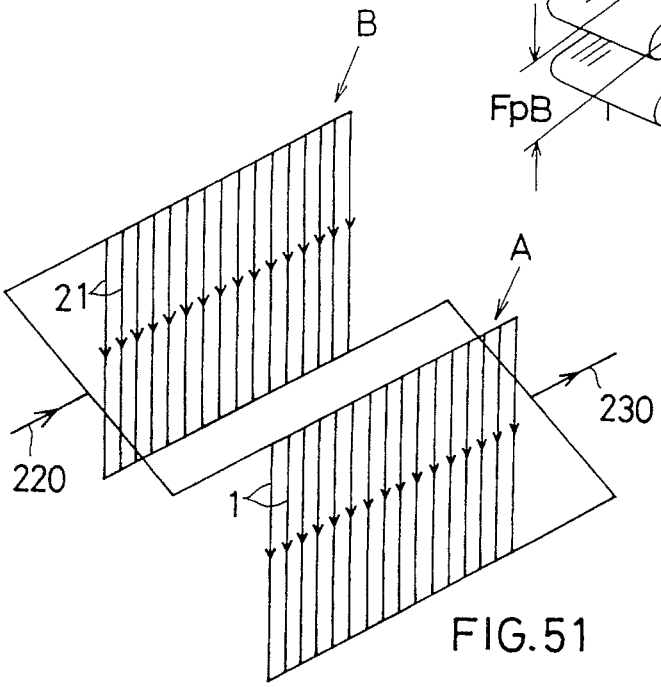

FIGS. 50 to 52 show a thirteenth embodiment of the present invention also applied to an evaporator for use in car coolers.

Tubes 1 and 21 are all disposed vertical from left to right and in parallel with each other, in each of the windward and leeward heat exchangers 'A' and 'B'. Headers: 3 and 4; and 23 and 24 lie horizontal and one above the other as shown in the ninth embodiment.

A bifurcate coolant inlet pipe 220 is connected to left-hand ends of the upper headers 3 and 23. A bifurcate outlet pipe 230 is connected to right-hand ends of the lower headers 4 and 24, so that a coolant circuit extending through the windward heat exchanger 'A' is provided in parallel with that formed through the leeward one 'B'. In operation, a coolant which has entered both the upper headers 3 and 23 of windward and leeward heat exchangers 'A' and 'B' through the inlet pipe 220 will then descend through the tubes 1 and 21 into the lower headers 4 and 24, before leaving this evaporator through the outlet pipe 230.

As will be seen in FIG. 52, and similarly to the ninth embodiment, a fin pitch '$Fp_B$' in each corrugated fin 22 in the leeward heat exchanger 'B' is greater than that '$Fp_A$' in each corrugated fin 2 in the windward one 'A'. This means that unit air flow paths each defined between the adjacent tubes and separated by the fins in the leeward heat exchanger 'B' are larger than those in the windward one 'A'.

Such a greater fin pitch '$Fp_B$' in the leeward heat exchanger 'B' is effective, similarly to the ninth to twelfth embodiments, to prevent the 'water-drop' from flying from the leeward heat exchanger towards an automobile cabin. This problem inherent in the prior art evaporators has been caused by a violent air flow blowing between the fins.

One or more partition plates may be secured in the upper and/or lower headers in order to cause the coolant to meander.

Fourteenth Embodiment

Figure 53:
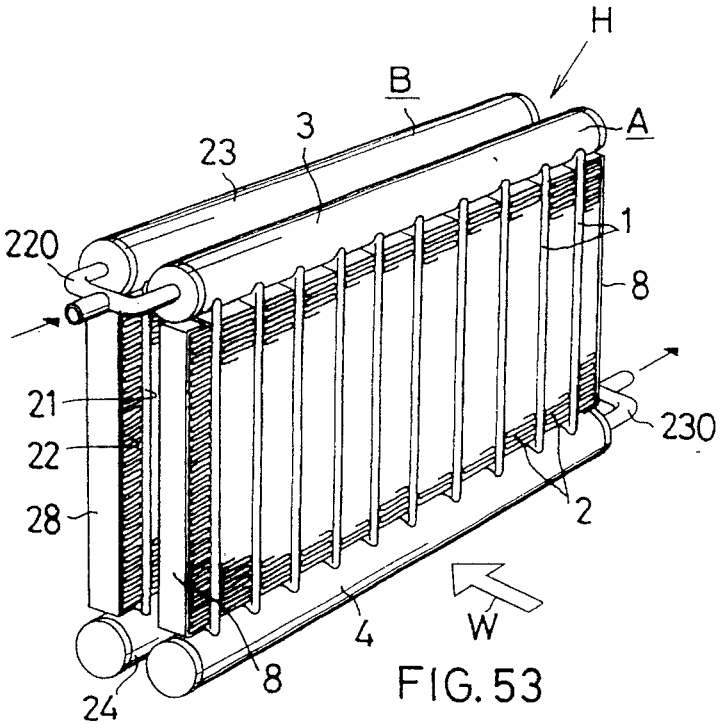
Figure 55:
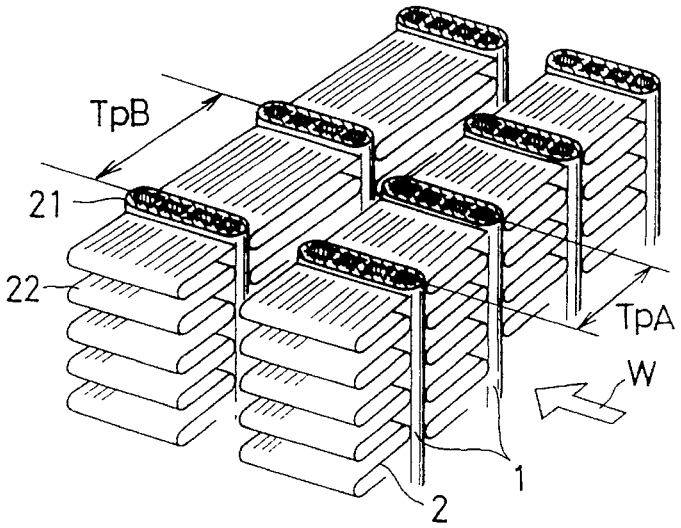
Figure 54:
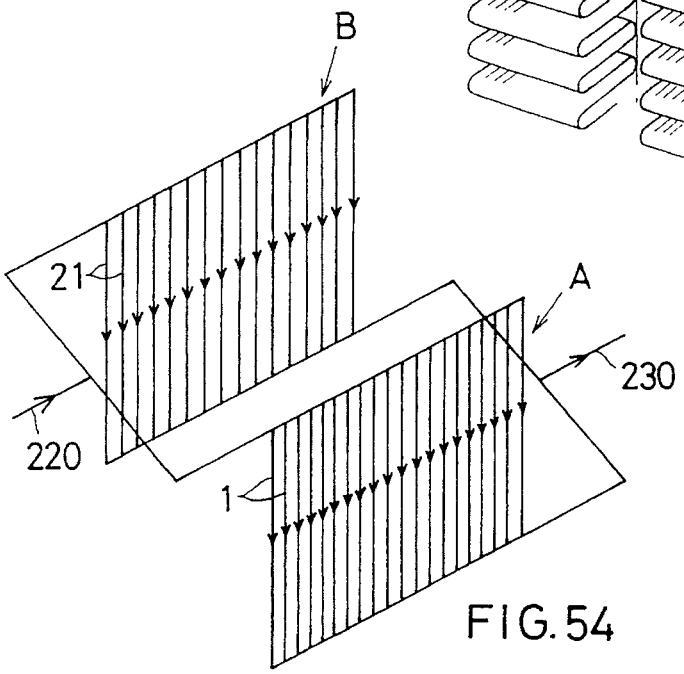

FIGS. 53 to 55 show a fourteenth embodiment of the invention also applied to an evaporator for car coolers.

In this embodiment, a windward and leeward unit heat exchangers 'A' and 'B' having different tube pitches are arranged fore and aft, in a manner similar to those in the tenth embodiment. Coolant circuits which are formed respectively through those heat exchangers 'A' and 'B' are however in parallel with one another, similarly to the thirteenth embodiment. Description of the corresponding elements to which the same reference numerals are allotted is not repeated here.

As seen in FIG. 55, this evaporator is characterized in that a tube pitch '$Tp_B$' in the leeward heat exchanger 'B' is greater than that '$Tp_A$' in the windward one 'A', whereby unit air flow paths each defined between the adjacent tubes and separated by the fins in the former 'B' are larger than those in the latter 'A'. Due to such a greater tube pitch '$Tp_B$' in the leeward heat exchanger 'B', the air flow through the paths separated by the fins between the adjacent tubes is also prevented herein from causing the so-called 'water-drop-flying' from the leeward heat exchanger towards the automobile cabin, similarly to the ninth to thirteenth embodiments.

Fifteenth Embodiment

Figure 56:
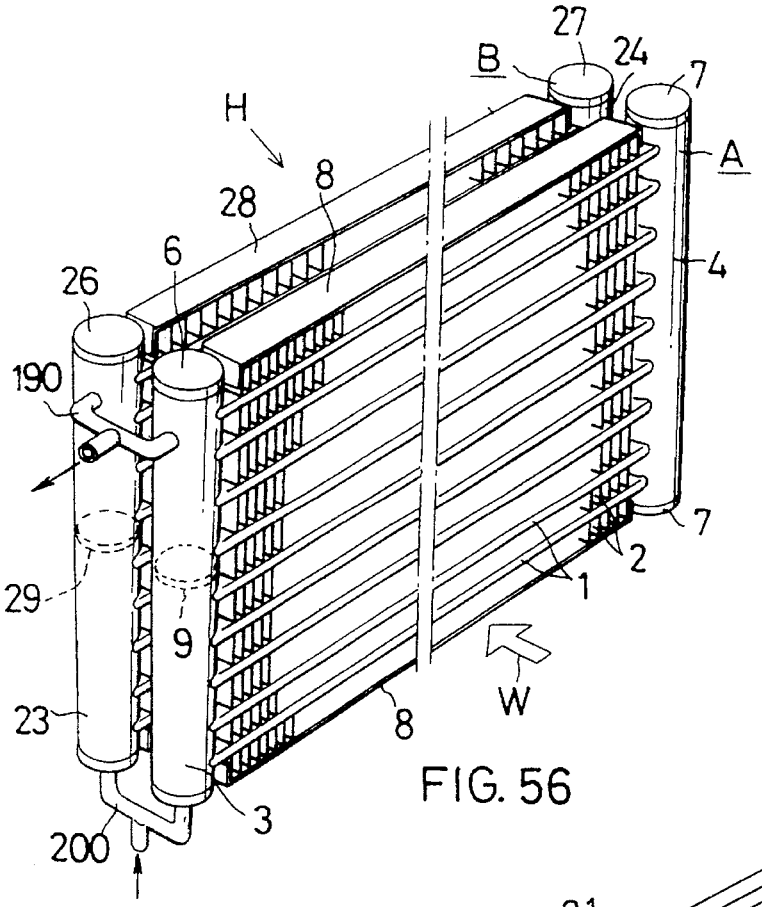
Figure 57:
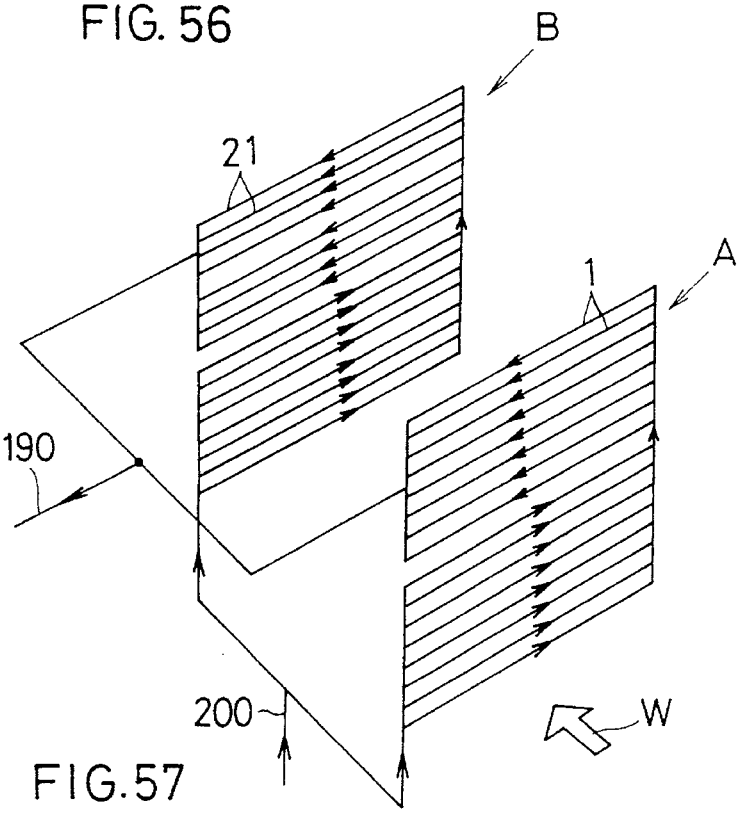
Figure 58:
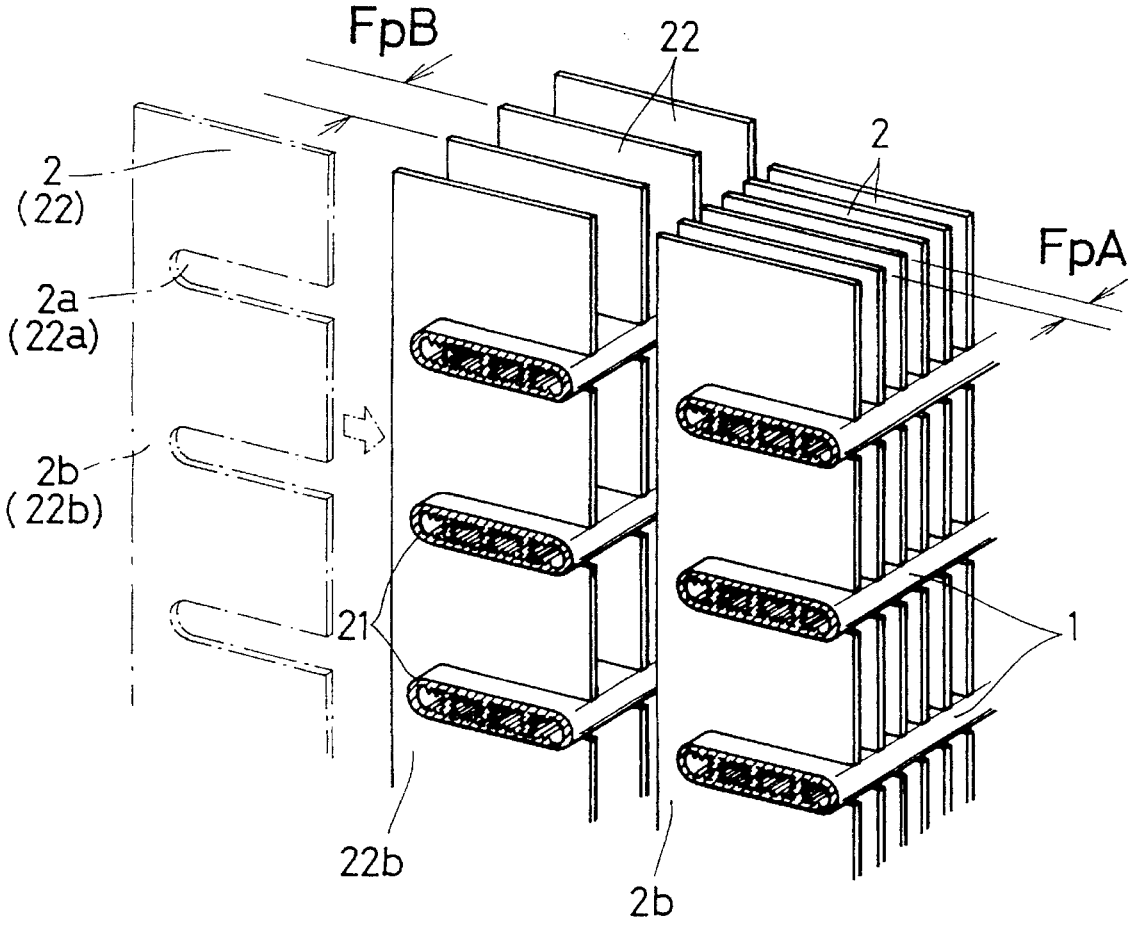

FIGS. 56 to 58 show a fifteenth embodiment of the invention also applied to an evaporator for car coolers.

This duplex heat exchanger comprises unit heat exchangers 'A' and 'B' of the same structure as those in the eleventh embodiment, but they are arranged to provide coolant circuits connected in parallel with each other.

A bifurcate coolant outlet pipe 190 is attached to upper portions of left-hand headers 3 and 23 in the unit heat exchangers 'A' and 'B'. A similarly bifurcate inlet pipe 200 is attached to bottoms of said headers 3 and 23. A partition plate 9 is secured in and at a middle height of the windward left-hand header 3, with another partition plate 29 being secured in the leeward left-hand header 23 at its middle height.

Those partition plates cause the coolant, which has entered the unit heat exchangers 'A' and 'B' through the inlet pipe 200, to make one U-turn within the respective heat exchangers before flowing into both the upper chambers of the left-hand headers 3 and 23 and leaving same through the outlet pipe 190, as shown in FIG. 57.

Fin pitch '$Fp_B$' in the leeward heat exchanger 'B' is larger than that '$Fp_A$' in the windward one 'A', in such a manner as shown in FIG. 58. Thus, unit air flow paths each defined through fins between the adjacent tubes in the former 'B' are larger than those in the latter 'A'.

Due to such a greater fin pitch '$Fp_B$' in the leeward heat exchanger 'B', the air flow through the paths is prevented also herein from causing the problem of 'water-drop-flying' from the leeward heat exchanger towards the automobile cabin, similarly to the fourteenth embodiment.

Sixteenth Embodiment

Figure 59:
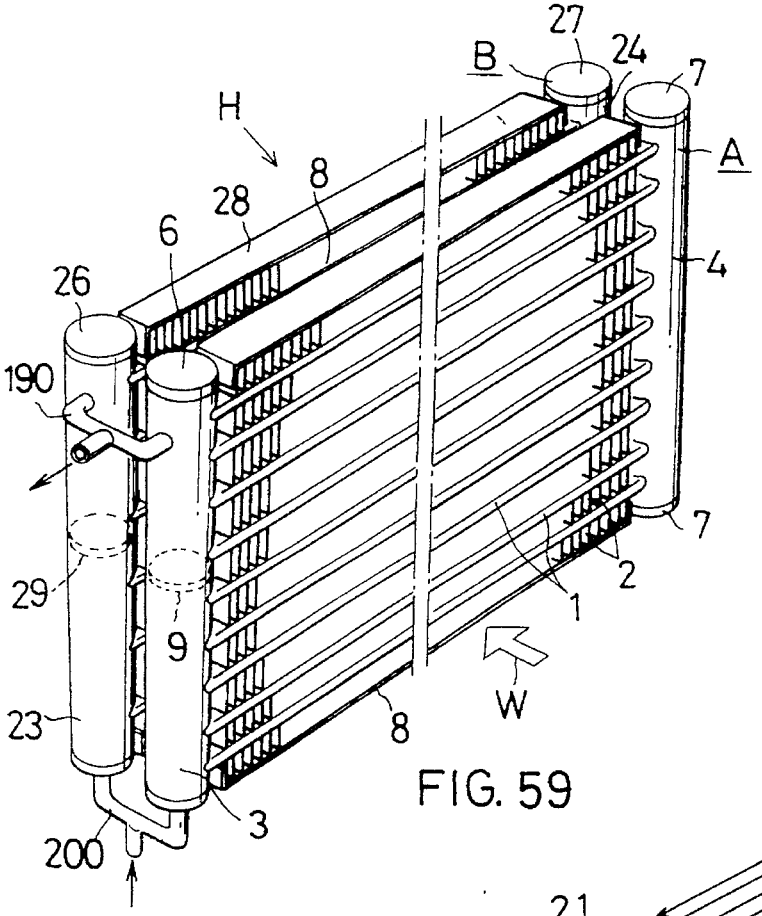
Figure 60:
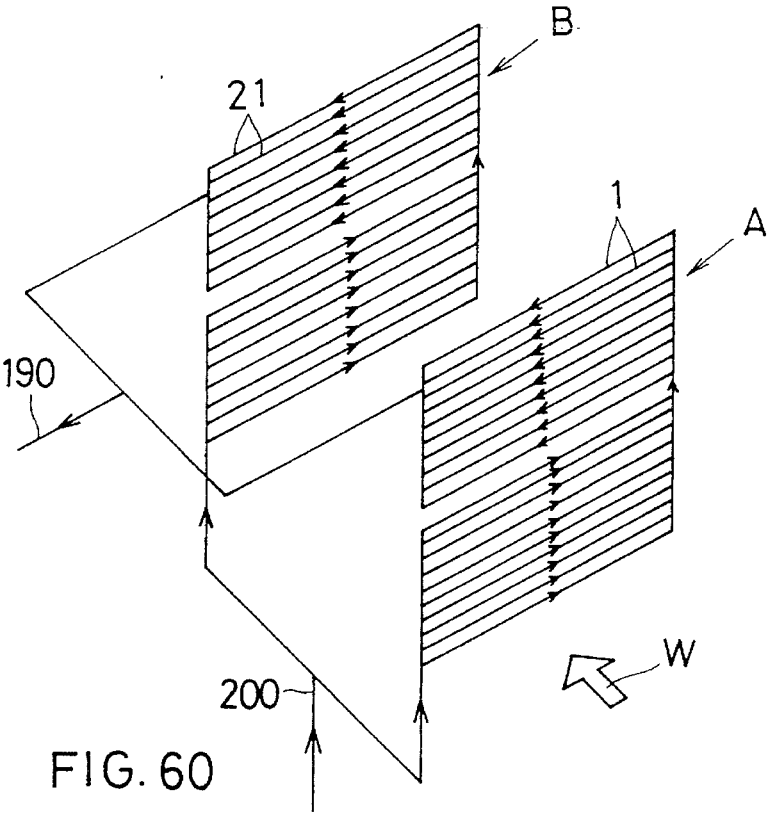
Figure 61:
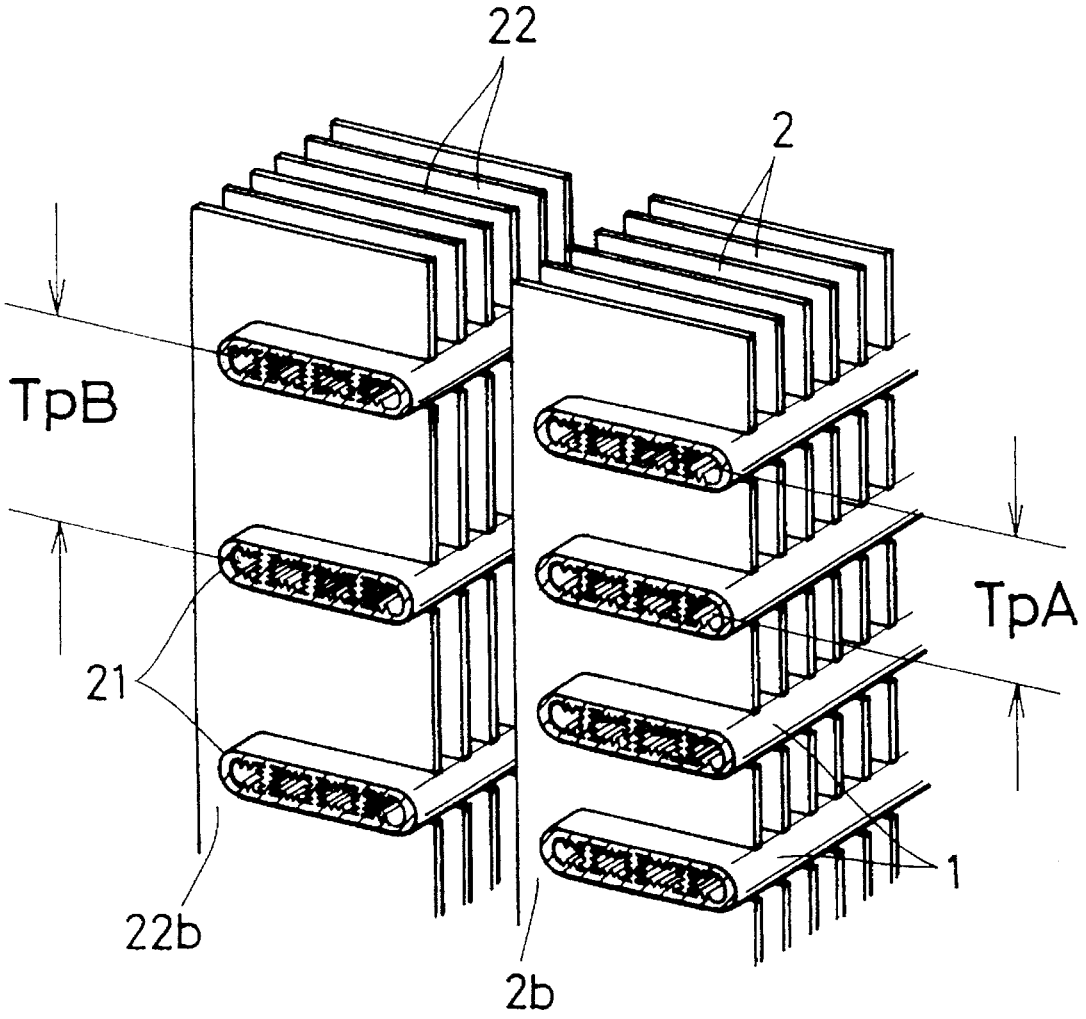

FIGS. 59 to 61 show a sixteenth embodiment of the invention also applied to an evaporator for car coolers.

In this embodiment, unit heat exchangers of the same structure as those in the twelfth embodiment are connected in parallel with one another in respect of their coolant circuits, similarly to the fifteenth embodiment.

However, the tube pitch in the leeward heat exchanger 'B' is greater than that which windward one 'A' has as shown in FIG. 59. Consequently, unit air flow paths each defined between the adjacent tubes and separated by the fins in the leeward heat exchanger 'B' are so larger than those in the windward one 'A' that the problem of 'water-drop-flying' from the leeward heat exchanger is resolved also in this embodiment.

The duplex heat exchanger is provided for use as an evaporator in the ninth to sixteenth embodiments, and is characterized in that the cross-sectional area of air flow paths formed between the tubes and separated by the fins in the leeward heat exchanger is larger than that in the windward one. Thus, the problem of 'water-drop-flying' is resolved, and any modification is employable insofar as such a feature is ensured.

What is claimed is:

1. A duplex heat exchanger which comprises:

a plurality of unit heat exchangers;

each of the unit heat exchangers having a circuit formed therethrough for a heat exchanging medium; and a connecting means for connecting the circuits in fluid communication with each other, each of the unit heat exchangers comprising:

a plurality of tubes arranged in parallel with each other; and a pair of hollow headers to which both ends of each tube are connected in fluid communication, wherein the unit heat exchangers are arranged fore and aft in a direction of air flow so that one unit heat exchanger face the windward, with the other unit heat exchanger lying leeward, in such a state that the headers of the windward and leeward unit heat exchangers are offset relative to one another with respect to the direction of air flow.

2. A duplex heat exchanger according to claim 1, wherein a distance between the headers in the windward unit heat exchanger is smaller than that in the leeward unit heat exchanger.

3. A duplex heat exchanger according to claim 1, wherein the circuits formed through the unit heat exchangers for the heat exchanging medium are connected in series to each other so that the heat exchanging medium flows successively through one of the circuits and then through the other circuits, in such a manner as adapted for use of the duplex heat exchanger as a condenser.

4. A duplex heat exchanger according to claim 3, wherein the heat exchanging medium is caused to flow from the leeward unit heat exchanger into the windward unit heat exchanger.

5. A duplex heat exchanger comprising:

a plurality of unit heat exchangers;

each of the unit heat exchangers having a circuit formed therethrough for a heat exchanging medium; and a connecting means for connecting the circuits in fluid communication with each other, each of the unit heat exchangers comprising:

a plurality of tubes arranged in parallel with each other; and a pair of hollow headers to which both ends of each tube are connected in fluid communication, wherein the unit heat exchangers are arranged fore and aft in a direction of air flow so that one unit heat exchanger faces the windward, with the other unit heat exchanger lying leeward, wherein the circuits formed through the unit heat exchangers for the heat exchanging medium are connected in series to each other so that the medium flows successively through the circuits, wherein a heat exchange area in contact with the air flow per unit area of the leeward unit heat exchanger is larger than that of the windward unit heat exchanger in such a manner as adapted for use of the duplex heat exchanger as a condenser; and wherein each unit heat exchanger further comprises:

partitioning means fixed inside at least one of the headers so as to divide an internal space thereof into at least two sections so that paths for the medium in the unit heat exchangers are menders which made zigzag turns caused by the partitioning means.

6. A duplex heat exchanger according to claim 5, wherein the heat exchanging medium is caused to flow from the leeward unit heat exchanger into the windwards unit heat exchanger.

7. A duplex heat exchanger according to claim 5, wherein each unit heat exchanger has a plurality of fins arranged at a fin pitch and each interposed between two adjacent tubes, and wherein the fin pitch in the leeward unit heat exchanger is smaller than the fin pitch in the windward unit heat exchanger so that the heat exchange area in contact with the air flow per unit area of the leeward unit heat exchanger is larger than that of the windward unit heat exchanger.

8. A duplex heat exchanger according to claim 5, wherein a tube pitch in the leeward unit heat exchanger is smaller than a tube pitch in the windward unit heat exchanger such that the heat exchange area in contact with the air flow per unit area of the leeward unit heat exchanger is larger than that of the windward unit heat exchanger.

9. A duplex heat exchanger adapted for use as a condenser and comprising:

a plurality of unit heat exchangers;

each of the unit heat exchangers having a circuit formed therethrough for a heat exchanging medium; and a connecting means for connecting the circuits in fluid communication with each other, each of the unit heat exchangers comprising:

a plurality of tubes arranged in parallel with each other;

a plurality of fins each interposed between the two adjacent tubes; and a pair of hollow headers to which both ends of each tube are connected in fluid communication, wherein the unit heat exchangers are arranged fore and aft in a direction of air flow so that one unit heat exchanger faces the windward, with the other unit heat exchanger lying leeward, wherein the circuits formed through the unit heat exchangers for the heat exchanging medium are connected in series to each other so that the medium flows successively through the circuits, and wherein each unit heat exchanger comprising: partitioning means fixed inside at least one of the headers so as to divide an internal space thereof into at least two sections in a manner such that paths for the medium in the unit heat exchangers are meanders which made zigzag turns caused by the partitioning means, the medium flows from one unit heat exchanger lying on the leeward into the other unit heat exchanger standing to the windward of said air flow;

the sections including: an inlet section formed in the unit heat exchanger lying on the leeward; and outlet section formed in the other unit heat exchanger standing to the windward;

the total cross-sectional area of the paths formed through the tubes connected to the outlet section being smaller than that formed through the other tubes connected to the inlet section;

the fin pitch of the unit heat exchanger lying on the leeward being smaller than that of the other unit heat exchange standing to the windward.

10. A duplex heat exchanger adapted for use as a condenser and comprising:

a plurality of unit heat exchangers;

each of the unit heat exchangers having a circuit formed therethrough for a heat exchanging medium; and a connecting means for connecting the circuits in fluid communication with each other, each of the unit heat exchangers comprising:

a plurality of tubes arranged in parallel with each other; and a pair of hollow headers to which both ends of each tube are connected in fluid communication, wherein the unit heat exchangers are arranged fore and aft in a direction of air flow so that one unit heat exchanger faces the windward, with the other unit heat exchanger lying leeward wherein the circuits formed through the unit heat exchangers for the heat exchanging medium are connected in series to each other so that the medium flows successively through the circuits, and wherein each unit heat exchanger comprising: partitioning means fixed inside at least one of the headers so as to divide an internal space thereof into at least two sections in a manner such that paths for the medium in the unit heat exchangers are meanders which make zigzag turns caused by the partitioning means, the medium flows from one unit heat exchanger lying on the leeward into the other unit heat exchanger standing to the windward of said air flow;

the sections including: an inlet section formed in the unit heat exchanger lying on the leeward; and outlet section formed in the other unit heat exchanger standing to the windward;

the total cross-sectional area of the paths formed through the tubes connected to the outlet section being smaller than that formed through the other tubes connected to the inlet section;

the number of U-turns within the circuit in the windward unit heat exchanger being greater than that in the leeward unit heat exchanger.

11. A duplex heat exchanger adapted for use as a condenser and comprising:

a plurality of unit heat exchangers;

each of the unit heat exchangers having a circuit formed therethrough for a heat exchanging medium; and a connecting means for connecting the circuits in fluid communication with each other, each of the unit heat exchangers comprising:

a plurality of tubes arranged in parallel with each other; and a pair of hollow headers to which both ends of each tube are connected in fluid communication, wherein the unit heat exchangers are arranged fore and aft in a direction of air flow so that one unit heat exchanger faces the windward, with the other unit heat exchanger lying leeward, wherein the circuits formed through the unit heat exchangers for the heat exchanging medium are connected in series to each other so that the medium flows successively through the circuits, and wherein each unit heat exchanger comprising: partitioning means fixed inside at least one of the headers so as to divide an internal space thereof into at least two sections in a manner such that paths for the medium in the unit heat exchangers are meanders which make zigzag turns caused by the partitioning means, the medium flows from one unit heat exchanger lying on the leeward into the other unit heat exchanger standing to the windward of said air flow;

the sections including: an inlet section formed in the unit heat exchanger lying on the leeward; and outlet section formed in the other unit heat exchanger standing to the windward;

the total cross-sectional area of the paths formed through the tubes connected to the outlet section being smaller than that formed through the other tubes connected to the inlet section;

the headers of the windward and leeward unit heat exchangers being offset one another with respect to the direction of air flow, wherein a distance between the headers in the windward unit heat exchanger being smaller than that in the leeward one.

* * * * *